US010705474B2

(12) United States Patent
Horiguchi et al.

(10) Patent No.: US 10,705,474 B2
(45) Date of Patent: Jul. 7, 2020

(54) IMAGE POST-PROCESSING METHOD AND APPARATUS FOR EMITTING A GLOSSINESS CONTROL LIGHT, AND IMAGE FORMING APPARATUS

(71) Applicant: Konica Minolta, Inc., Tokyo (JP)

(72) Inventors: Haruo Horiguchi, Koganei (JP); Seijiro Takahashi, Kokubunji (JP); Toyoko Shibata, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/186,035

(22) Filed: Nov. 9, 2018

(65) Prior Publication Data

US 2019/0187606 A1 Jun. 20, 2019

(30) Foreign Application Priority Data

Dec. 18, 2017 (JP) ..... 2017-241271

(51) Int. Cl.
*G03G 15/00* (2006.01)
*G03G 15/20* (2006.01)

(52) U.S. Cl.
CPC ..... *G03G 15/6585* (2013.01); *G03G 15/20* (2013.01); *G03G 15/2007* (2013.01); *G03G 15/2021* (2013.01); *G03G 15/50* (2013.01); *G03G 15/5062* (2013.01); *G03G 15/6582* (2013.01); *G03G 2215/0081* (2013.01); *G03G 2215/00426* (2013.01); *G03G 2215/00805* (2013.01)

(58) Field of Classification Search
CPC ..... G03G 13/20; G03G 15/2007; G03G 15/2021; G03G 15/22; G03G 15/50; G03G 15/5062; G03G 15/6582; G03G 15/6585; G03G 2215/00426; G03G 2215/00805; G03G 2215/0081
See application file for complete search history.

(56) References Cited

U.S. PATENT DOCUMENTS 7,672,634 B2 * 3/2010 Lofthus ..... G03G 15/2003 399/341
2007/0148414 A1 * 6/2007 Halfyard ..... G03G 8/00 428/195.1
2013/0243503 A1 * 9/2013 Hirayama ..... G03G 15/2021 399/341

FOREIGN PATENT DOCUMENTS

JP 2007072022 A 3/2007

* cited by examiner

*Primary Examiner* — Joseph S Wong
(74) *Attorney, Agent, or Firm* — Lucas & Mercanti, LLP

(57) ABSTRACT

There is disclosed an image post-processing method for adjusting glossiness of a fixed toner image. The method includes a glossiness control step and a temperature control step. The glossiness control step is a step of, to a toner image formed of a toner containing a light absorbing compound and fixed to a recording medium, emitting glossiness control light so as to reduce or increase glossiness of the toner image. The temperature control step is a step of heating the toner image immediately before the light is emitted to the toner image such that the toner image has a surface temperature which is at least 20° C. lower than a softening temperature of the toner. The glossiness control light has a maximum emission wavelength in a wavelength range in which the compound absorbs light and is made to at least reduce the glossiness of the toner image.

18 Claims, 6 Drawing Sheets

IMAGE POST-PROCESSING METHOD AND APPARATUS FOR EMITTING A GLOSSINESS CONTROL LIGHT, AND IMAGE FORMING APPARATUS

BACKGROUND

1. Technological Field

The present invention relates to an image post-processing method, an image post-processing apparatus and an image forming apparatus. More specifically, the present invention relates to an image post-processing method, an image post-processing apparatus and an image forming apparatus which can adjust glossiness of toner images with no influence on fixability of the toner images.

2. Description of the Related Art

In recent years, recording media where images are formed have been diversified in type. For example, high quality paper and coated paper are different from one another in surface shape, and accordingly different from one another in gloss (glossiness). Further, in a case where a toner image is formed on a recording medium, if glossiness of a portion where the image is formed (image portion) is greatly different from that of a portion where the image is not formed (no-image portion), namely, a bare portion of the recording medium, a user(s) may feel something strange.

Then, there is known a fixing device for controlling glossiness of toner images. The fixing device changes a toner-image fixing temperature, thereby choosing/switching between glossing a toner image(s) and not glossing the toner image(s). (Refer to, for example, JP 2007-72022 A.) However, in this case, where glossiness of toner images is controlled by the fixing temperature, when glossiness of a toner image is to be reduced, the amount of heat to be given to the toner image is not enough to fix the toner image to a recording medium, and hence fixing strength of the toner image to the recording medium is insufficient.

SUMMARY

The present invention has been conceived in view of the above problems and circumstances, and objects of the present invention include providing an image post-processing method, an image post-processing apparatus and an image forming apparatus which can adjust glossiness of toner images with no influence on fixability of the toner images.

In order to achieve at least one of the objects, according to an aspect of the present invention, there is provided an image post-processing method for adjusting glossiness of a fixed toner image, including: a glossiness control step of, to a toner image formed of a toner containing a light absorbing compound and fixed to a recording medium, emitting glossiness control light having a maximum emission wavelength in a wavelength range in which the compound absorbs light and made to at least reduce glossiness of the toner image so as to reduce or increase the glossiness of the toner image; and a temperature control step of heating the toner image immediately before the glossiness control light is emitted to the toner image such that the toner image has a surface temperature which is at least 20° C. lower than a softening temperature of the toner.

BRIEF DESCRIPTION OF THE DRAWINGS

The advantages and features provided by one or more embodiments of the present invention will become more fully understood from the detailed description given hereinbelow and the appended drawings which are given by way of illustration only, and thus are not intended as a definition of the limits of the present invention, wherein.

DETAILED DESCRIPTION OF EMBODIMENTS

Figure 1:
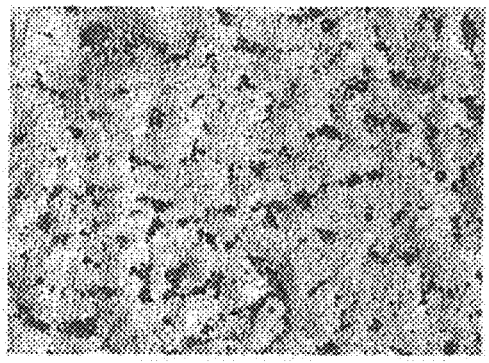
FIG. 1 is an observation view showing a state of the surface of a toner image fixed to a recording medium before a glossiness control step.

Hereinafter, one or more embodiments of the present invention will be described with reference to the drawings. However, the scope of the present invention is not limited to the disclosed embodiments.

An image post-processing method of the present invention is an image post-processing method for adjusting glossiness of a fixed toner image(s), including: a glossiness control step of, to a toner image(s) formed of a toner containing a light absorbing compound and fixed to a recording medium (media), emitting glossiness control light having a maximum emission wavelength in a wavelength range in which the compound absorbs light and made to at least reduce glossiness of the toner image so as to reduce or increase the glossiness of the toner image; and a temperature control step of heating the toner image immediately before the glossiness control light is emitted to the toner image such that the toner image has a surface temperature which is at least 20° C. lower than a softening temperature of the toner. These features are technical features shared by or corresponding to the embodiments below.

According to the present invention, there can be provided an image post-processing method, an image post-processing apparatus and an image forming apparatus which can adjust glossiness of a toner image(s) with no influence on fixability of the toner image.

An expression mechanism or an action mechanism of effects of the present invention is conjectured as follows.

When light in a wavelength range which is absorbed by a compound is emitted to the compound, the compound transits from the ground state to an excited state, and emits heat energy equivalent to the absorbed light energy when returns back to the ground state by non-radiative deactivation. When the light in the wavelength range which is absorbed by such a compound (e.g. a colorant, an UV (ultraviolet) absorber, etc.) is emitted to toner containing the compound, an effect of softening/melting resin around the compound by the emitted heat energy is obtained.

In order to conceive the present invention, attention has been paid to a softening or melting phenomenon of toner by light emission (irradiation). The present invention can control the glossiness of a fixed toner image(s) by emitting light to the toner image, thereby re-softening or re-melting the toner, so as to change the state of the surface of the toner image.

More specifically, for example, when light is emitted to the fixed toner image with a light amount which does not re-melt but softens the toner, elasticity of the fixed toner is recovered, which increases irregularity on the surface of the image. Consequently, the glossiness becomes lower than that before light emission.

On the other hand, when light is emitted to the fixed toner image with a light amount larger than the above, the toner is re-melted, and the entire image becomes smooth. Consequently, the glossiness becomes higher than that before light emission.

Thus, light emission to the toner image can reduce or increase the glossiness of the toner image, namely, can control the glossiness of the toner image.

The image post-processing method of the present invention can control the glossiness of the fixed toner image not by changing the fixing temperature of the image as described in JP 2007-72022 A but by simply emitting predetermined glossiness control light to the fixed toner image.

Thus, the image post-processing method of the present invention can control the glossiness of the toner image with no influence on the fixability of the toner image.

In the present invention, before light emission, the toner image is heated to have a surface temperature which is at least 20° C. lower than the softening temperature of the toner. This can heat the toner image to the extent that the glossiness does not change, and make the light amount to be emitted necessary to achieve desired glossiness small. From this, it is conjectured that glossiness unevenness after light emission is less, and image texture uniformity is improved.

As an embodiment of the present invention, preferably, the temperature control step is a step of performing the heating without contacting a face of the toner image to be irradiated with the glossiness control light. Thus, the heating can be performed by a method which hardly changes an irregularity/roughness state of the surface of the toner image.

As an embodiment of the present invention, preferably, the temperature control step is a step of fixing the toner image to the recording medium. Using the toner-image fixing step in which heating is performed as the temperature control step eliminates a need to separately provide a heating step after the fixing step. This can reduce the number of steps, and exhibit the effects of the present invention with a simpler method. That is, because fixing and heating are performed simultaneously, the number of steps can be reduced, and the effects of the present invention can be obtained with a simpler method.

As an embodiment of the present invention, preferably, the temperature control step is a step of heating the toner image immediately before the glossiness control light is emitted to the toner image such that the toner image has the surface temperature which is 40° C. or higher. Heating the toner image such that the toner image has the surface temperature which is at least 15° C. higher than a room temperature (25° C.) can make the light amount to be emitted necessary to achieve desired glossiness smaller. This can make glossiness unevenness of the toner image after emission of the glossiness control light less than that of the toner image before emission thereof.

As an embodiment of the present invention, from the viewpoint of obtaining the effects of the present invention more effectively, preferably, the temperature control step is a step of heating the toner image immediately before the glossiness control light is emitted to the toner image such that the toner image has the surface temperature which is at least 30° C. lower than the softening temperature of the toner.

As an embodiment of the present invention, preferably, in the glossiness control step, the light amount of the glossiness control light is adjusted based on glossiness information specified by a user. This can emit the glossiness control light to the toner image with the light amount for the glossiness specified by a user.

As an embodiment of the present invention, preferably, in the glossiness control step, the light amount of the glossiness control light is adjusted based on relationship information on change in the glossiness of the toner image with respect to the light amount of the glossiness control light to be emitted. This can adjust the light amount for the glossiness specified by the user more precisely.

As an embodiment of the present invention, preferably, in the glossiness control step, an irradiation position to which the glossiness control light is emitted is set based on position information on the toner image, the position information being specified by a user. This can reduce or increase the glossiness of, of the toner image, only a portion at a specific position.

As an embodiment of the present invention, preferably, in the glossiness control step, the glossiness control light is emitted to the toner image fixed to a plurality of portions on the recording medium. This can reduce or increase the glossiness of each of the toner images fixed to the recording medium at positions thereon which are apart from one another.

As an embodiment of the present invention, preferably, the glossiness control light has the maximum emission wavelength in the wavelength range of 280 nm to 850 nm. In order to reduce or increase the glossiness of the toner image, it is necessary to efficiently re-melt (or re-soften) the toner. Then, the compound (e.g. a colorant, an UV absorber, etc.) which absorbs light in the wavelength range of 280 nm to 850 nm, has a large excitation energy, and is contained in the toner is irradiated with the light having the maximum emission wavelength in the wavelength range in which the compound absorbs light. This makes it easy to control the glossiness of the toner image.

As an embodiment of the present invention, preferably, the glossiness control light has the maximum emission wavelength in the wavelength range of 280 nm to 500 nm. The maximum emission wavelength being in this wavelength range can produce enough energy for the glossiness control light to change the glossiness. This can eliminate a need to change a light source depending on the type of the colorant used in the toner, and can save the space of an apparatus which performs image post-processing.

As an embodiment of the present invention, from the viewpoint of obtaining the effects of the present invention effectively, preferably, a colorant is used as the compound.

As an embodiment of the present invention, from the viewpoint of obtaining the effects of the present invention effectively, preferably, an ultraviolet absorber is used as the compound.

As an embodiment of the present invention, preferably, the image post-processing method further includes, before the glossiness control step, a step of detecting the glossiness of the toner image fixed to the recording medium. This can adjust the glossiness more accurately.

An image post-processing apparatus of the present invention is an image post-processing apparatus including: a light emitter; a heating device; and a hardware processor which causes the light emitter to, to a toner image(s) formed of a toner containing a light absorbing compound and fixed to a recording medium (media), emit glossiness control light having a maximum emission wavelength in a wavelength range in which the compound absorbs light and made to at least reduce glossiness of the toner image so as to reduce or increase the glossiness of the toner image, and causes the heating device to heat the toner image immediately before the glossiness control light is emitted to the toner image such that the toner image has a surface temperature which is at least 20° C. lower than a softening temperature of the toner.

An image forming apparatus of the present invention is an image forming apparatus including: a transfer unit which transfers, onto a recording medium (media), a toner image(s) formed, in a developing unit, of a toner containing a light absorbing compound; a fixing unit which fixes the toner image to the recording medium; a light emitter; a heating device; and a hardware processor which causes the light emitter to, to the toner image fixed to the recording medium, emit glossiness control light having a maximum emission wavelength in a wavelength range in which the compound absorbs light and made to at least reduce glossiness of the toner image so as to reduce or increase the glossiness of the toner image, and causes the heating device to heat the toner image immediately before the glossiness control light is emitted to the toner image such that the toner image has a surface temperature which is at least 20° C. lower than a softening temperature of the toner.

Another image forming apparatus of the present invention is an image forming apparatus including: a transfer unit which transfers, onto a recording medium (media), a toner image(s) formed, in a developing unit, of a toner containing a light absorbing compound; and a fixing unit which fixes the toner image to the recording medium, wherein the above-described image post-processing apparatus is attached to the image forming apparatus.

Hereinafter, the present invention and elements thereof as well as configurations and embodiments for carrying out the present invention will be described in detail. In this application, "-(to)" between numerical values is used to mean that the numerical values before and after the sign are inclusive as the lower limit and the upper limit.

[Image Post-Processing Method]

An image post-processing method of the present invention is an image post-processing method for adjusting glossiness of a fixed toner image(s), including: a glossiness control step of, to a toner image(s) formed of a toner containing a light absorbing compound and fixed to a recording medium (media), emitting glossiness control light having a maximum emission wavelength in a wavelength range in which the compound absorbs light and made to at least reduce glossiness of the toner image so as to reduce or increase the glossiness of the toner image; and a temperature control step of heating the toner image immediately before the glossiness control light is emitted to the toner image such that the toner image has a surface temperature which is at least 20° C. lower than a softening temperature of the toner.

<Glossiness Control Step>

The glossiness control step is a step of, to a toner image(s) formed of a toner containing a light absorbing compound and fixed to a recording medium (media), emitting glossiness control light having a maximum emission wavelength in a wavelength range in which the compound absorbs light and made to at least reduce glossiness of the toner image so as to reduce or increase the glossiness of the toner image.

More specifically, in the glossiness control step, for example, when the glossiness control light is emitted to the fixed toner image with a light amount which does not re-melt but softens the toner, elasticity of the fixed toner is recovered, which increases irregularity on the surface of the image. Consequently, the glossiness becomes lower than that before light emission. On the other hand, when the glossiness control light is emitted to the fixed toner image with a light amount larger than the above, the toner is re-melted, and the entire image becomes smooth. Consequently, the glossiness becomes higher than that before light emission.

Figure 2:
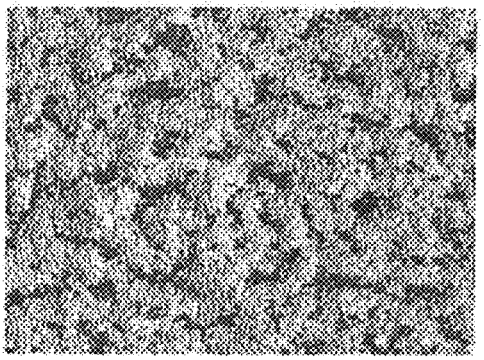
FIG. 2 is an observation view showing a state of the surface of the toner image heated by a non-contact heating device to a temperature which does not re-melt but softens toner of the toner image.
Figure 3:
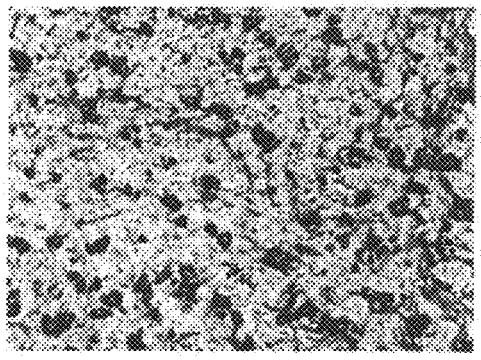
FIG. 3 is an observation view showing a state of the surface of the toner image heated by the non-contact heating device to a temperature which re-melts the toner.

FIG. 1 to FIG. 3 show images obtained by observing, under a laser microscope, a toner image formed on a recording medium.

FIG. 1 shows a state of the surface of the toner image fixed to the recording medium before the toner image is irradiated with the glossiness control light.

FIG. 2 shows a state of the surface of the toner image shown in FIG. 1 irradiated with the glossiness control light with a small light amount which does not re-melt but softens the toner. As shown in FIG. 2, elasticity of the fixed toner is recovered, and irregularity on the surface of the image is increased, so that the glossiness becomes lower than that before light emission.

FIG. 3 shows a state of the surface of the toner image shown in FIG. 1 irradiated with the glossiness control light with a large light amount. As shown in FIG. 3, the toner is re-melted by being irradiated with the glossiness control light with a large light amount, and the entire image becomes smooth, so that the glossiness becomes higher than that before light emission.

It is preferable that the glossiness control light be light having the maximum emission wavelength in a wavelength range of 280 nm to 850 nm. In order to reduce or increase the glossiness of the toner image, it is necessary to efficiently re-melt (or re-soften) the toner. Then, the compound (e.g. a colorant, an UV absorber, etc.) which absorbs light in the wavelength range of 280 nm to 850 nm, has a large excitation energy, and is contained in the toner is irradiated with the light having the maximum emission wavelength in the wavelength range in which the compound absorbs light. This makes it easy to control the glossiness of the toner image.

From the viewpoint that the efficient re-melt of the toner makes it easy to adjust the glossiness of the toner, it is preferable that the maximum absorption wavelength of the light absorbing compound contained in the toner and the emission wavelength of the glossiness control light coincide.

The glossiness control light may be any light as far as it can at least reduce the glossiness of the toner image. That is, it may be light which can only reduce the glossiness, or light which can both reduce and increase the glossiness. From the viewpoint of widening the glossiness controllable range, it is preferable that the glossiness control light be light which can both reduce and increase the glossiness.

Figure 4:
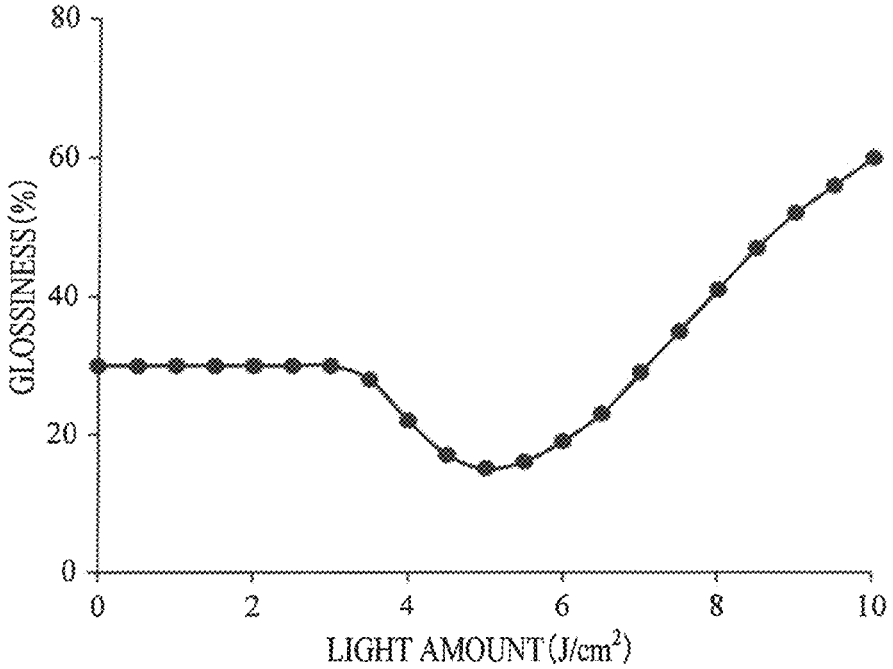
FIG. 4 is a graph showing change in glossiness (%) of a toner image with respect to light amount (J/cm$^2$) of glossiness control light.

FIG. 4 shows a graph showing a relationship of change in the glossiness (%) of a certain toner image(s) fixed to a recording medium (media) with respect to the light amount ($J/cm^2$) of certain glossiness control light when the glossiness control light is emitted to the toner image (i.e. when the toner image is irradiated with the glossiness control light). The graph shown in FIG. 4 shows not actual measured values but typical values schematically, and numerical values on the horizontal axis and the vertical axis are shown for purposes of illustration.

It is preferable, in the glossiness control step, to adjust the light amount of the glossiness control light on the basis of glossiness information specified by a user. This can emit the glossiness control light to the toner image with the light amount for the glossiness specified by the user.

The "glossiness information specified by a user" in the present invention is information which specifies how a user wishes to adjust the glossiness of the toner image. For example, it may be a specific numerical value of the glossiness, a result of selection about by how much the glossiness is reduced or increased from the current glossiness, or a result of simple selection about whether to reduce or increase the glossiness from the current glossiness.

The glossiness information may be set by the user with an input screen or the like when an image post-processing apparatus performs glossiness control or when an image forming apparatus performs image printing, for example. A controller 101 (hardware processor) described below determines the light amount of the glossiness control light on the basis of the glossiness information, and causes a light emitter 103 to emit the glossiness control light having the wavelength to the toner image with the light amount so as to change the glossiness of the toner image.

It is preferable that the light amount of the glossiness control light be adjusted on the basis of relationship information on change in the glossiness (%) of the toner image with respect to the light amount ($J/cm^2$) of the glossiness control light to be emitted. This can more precisely adjust the light amount for the glossiness specified by the user.

The relationship information on change in the glossiness (%) of the toner image with respect to the light amount ($J/cm^2$) of the glossiness control light is, for example, the graph as shown in FIG. 4. The graph shows change in the glossiness (%) of a certain toner image(s) fixed to a recording medium (media) with respect to the light amount ($J/cm^2$) of predetermined glossiness control light when the glossiness control light is emitted to the toner image.

The graph shown in FIG. 4 may be created, for example, as follows: emit glossiness control light having a predetermined maximum emission wavelength (e.g. 365 nm) with an arbitrary light amount to a toner image (solid image) fixed to a recording medium; and plot the glossiness with respect to the emitted light amount. The glossiness in the present invention can be obtained by, with a gloss meter (Multi Gloss 268Plus manufactured by Konica Minolta, Inc.), measuring the glossiness (%) at an incident angle of 60° at five points in total on the toner image irradiated with the glossiness control light, and calculating the average value of the five points as the glossiness (%). The five points are: the center point of the image; and two points in each of the up and down directions of the long axis direction at 50 mm intervals from the center point of the image.

In order to adjust the glossiness more accurately, it is preferable to have, before the glossiness control step, a step of detecting the glossiness of the toner image fixed to the recording medium. If, for the fixed toner image, change in the glossiness (%) of the toner image with respect to the light amount ($J/cm^2$) of predetermined glossiness control light when the glossiness control light is emitted to the toner image as shown in FIG. 4 is obtained in advance, when the user specifies a numerical value of the glossiness (%), the light amount for the numerical value is emitted. That is, the glossiness control light can be emitted for the glossiness specified by the user.

There may be two or more light amounts to be emitted to change the current glossiness of the toner image to the specified glossiness. For example, in the case shown in FIG. 4, in order to reduce the glossiness to 20%, about 4.0 $J/cm^2$ of light or about 6.5 $J/cm^2$ of light may be emitted to the toner image. In such a case, it is preferable, for example, from the viewpoint of irradiation efficiency that weaker light, namely, a smaller amount (about 4.0 $J/cm^2$) of light be emitted.

In the glossiness control step, an irradiation position with the glossiness control light can be set on the basis of toner image position information specified by the user.

The image post-processing method of the present invention can make the glossiness of only a portion of a toner image(s) after emission of the glossiness control light lower or higher than that of the portion before emission thereof. That is, the image post-processing method of the present invention can emit the glossiness control light to only a portion of a toner image(s) at a position specified by the user, and hence can reduce or increase the glossiness of only the portion of the toner image at the specified position.

The "toner image position information specified by the user" in the present invention indicates a position (or portion) of/on a toner image fixed to a recording medium, the position being specified by the user to reduce or increase the glossiness. Here, the toner image position information on a position of/on a toner image, the position at which the glossiness is desired to be reduced or increased, may be selected/specified by any method as far as the method can select/specify the position. For example, the user may specify the position in advance with an input screen or the like, or the fixed toner image(s) may be displayed on a display and the user may specify the position while checking the toner image(s) displayed on the display. Then, the controller 101 described below causes the light emitter 103 to emit the glossiness control light on the basis of the position information. This can reduce or increase the glossiness of only a portion of the toner image(s), the portion being at the specific position specified by the user.

Further, because light emission to the specified position can adjust the glossiness of the fixed toner image at the specified position, an image post-processing apparatus or an image forming apparatus which can perform the image post-processing method of the present invention can also be used as a marking apparatus.

(Light Source)

Examples of a light source used in the light emitter 103 include a light emitting diode (LED) and a laser light source. One or more light sources may be installed.

The maximum emission wavelength of the glossiness control light is preferably in the wavelength range of 280 to 850 nm. The maximum emission wavelength being shorter than 280 nm causes bond cleavage of the compound and thereby lowers color reproducibility, whereas the maximum emission wavelength being longer than 850 nm makes it difficult to provide enough energy to change the glossiness.

The maximum emission wavelength of the glossiness control light is further preferably in a wavelength range of 280 to 500 nm. The maximum emission wavelength being in this wavelength range can produce enough energy to change the glossiness. This can eliminate a need to change the light source depending on the type of the colorant used in the toner, and can save the space of an apparatus which performs image post-processing.

(Light Amount)

The light amount of the glossiness control light to be emitted should be controlled within a range in which the effects of the present invention can be obtained by the content of the light absorbing compound contained in the toner. The light amount is controlled preferably within a range of 0.01 to 100 J/cm$^2$ and further preferably within a range of 0.01 to 50 J/cm$^2$.

<Temperature Control Step>

The temperature control step of the present invention is a step of heating the toner image immediately before the glossiness control light is emitted to the toner image such that the toner image has a surface temperature which is at least 20° C. lower than the softening temperature of the toner. This can heat the toner image to the extent that the glossiness does not change, and make the light amount to be emitted necessary to achieve desired glossiness small. From this, it is conjectured that glossiness unevenness after light emission is less, and image texture uniformity is improved.

It is preferable that the temperature control step be a step of performing the heating without contacting a face of the toner image to be irradiated with the glossiness control light.

In the present invention, the "heating without contacting" (hereinafter may be referred to as "non-contact heating") means heating toner images fixed to recording media without directly contacting the surfaces of the toner images. Examples of the non-contact heating method include a method for heating by infrared rays with a heater or the like, a method for heating by hot air blowing, a method for heating with a heating plate, and a method for heating by light emission.

In the case of the method for heating with a heating plate, for example, by placing a side of a recording medium on the heating plate, the side where no toner image is formed, a toner image formed on the other side of the recording medium can be heated. In this case, the toner image and the heating plate do not contact one another directly. That is, because the toner image and the heating plate do not contact one another, the method for heating with a heating plate is included in the scope of the non-contact heating method in the present invention.

Figure 5:
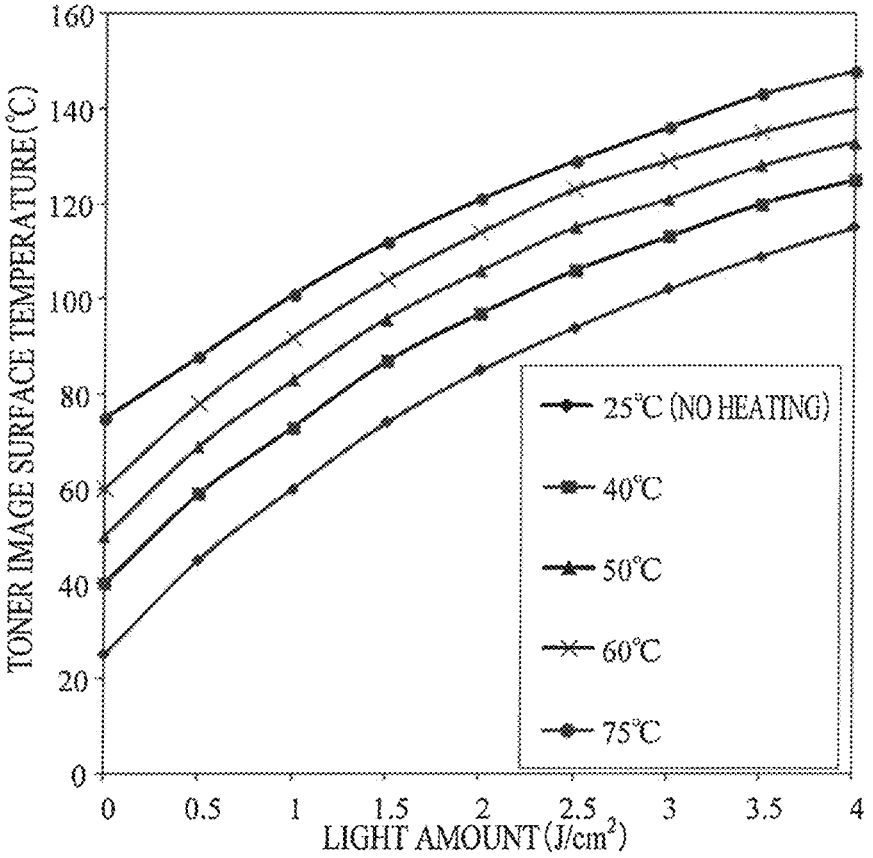
FIG. 5 is a graph showing change in surface temperature (° C.) of a toner image with respect to the light amount (J/cm$^2$) of the glossiness control light after the surface temperature of the toner image is made to be a predetermined temperature.
Figure 6:
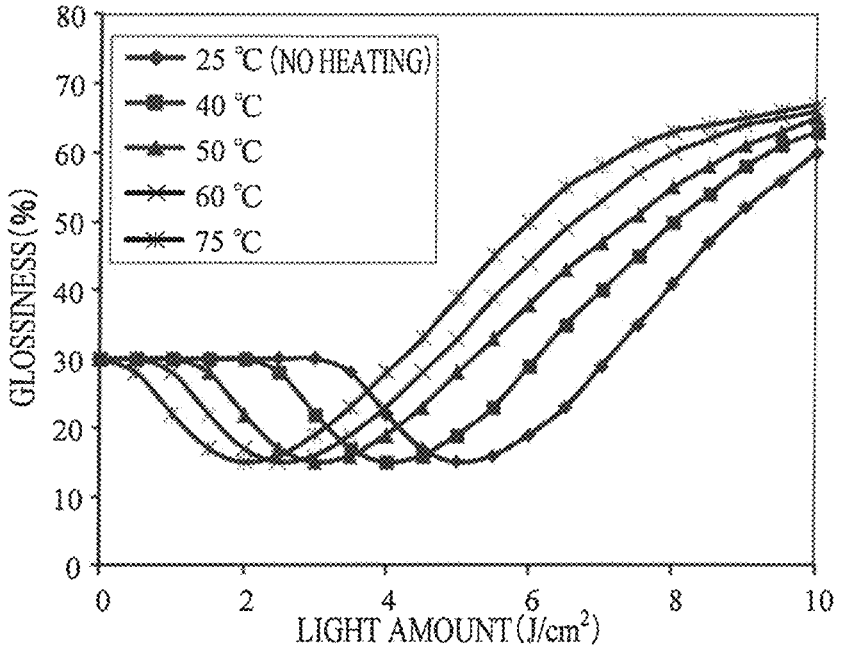
FIG. 6 is a graph showing change in glossiness (%) of a toner image with respect to the light amount (J/cm$^2$) of the glossiness control light after the surface temperature of the toner image is made to be a predetermined temperature.

FIG. 5 shows a graph showing a relationship of change in the surface temperature (° C.) of a certain toner image(s) fixed to a recording medium (media) with respect to the light amount (J/cm$^2$) of certain glossiness control light when the glossiness control light is emitted to the toner image. FIG. 6 is a graph showing a relationship of change in the glossiness (%) of a certain toner image(s) fixed to a recording medium (media) with respect to the light amount (J/cm$^2$) of certain glossiness control light when the glossiness control light is emitted to the toner image. FIG. 5 and FIG. 6 show the relationships after the heating to a predetermined temperature(s) is performed in the temperature control step.

The graphs shown in FIG. 5 and FIG. 6 show not actual measured values but typical values schematically, and numerical values on the horizontal axis and the vertical axis are shown for purposes of illustration.

In FIG. 5, the surface temperature of the toner image with a light amount of 0 J/cm$^2$ is the surface temperature (° C.) of the toner image heated in the temperature control step but not yet irradiated with the glossiness control light. As shown in FIG. 5, preheating in the temperature control step can increase the surface temperature of the toner image to a predetermined surface temperature with a smaller light amount in the glossiness control step. For example, in order to make the surface temperature of the toner image 100° C., if the toner image is not heated (25° C.) in the temperature control step, the necessary light amount in the glossiness control step is about 2.9 J/cm$^2$, and if the toner image is heated to 40° C., 50° C., 60° C. and 75° C. in the temperature control step, the necessary light amount is about 2.2 J/cm$^2$, about 1.7 J/cm$^2$, about 1.3 J/cm$^2$ and about 1.0 J/cm$^2$, respectively. Thus, as the toner image is heated to a higher temperature in the temperature control step, the surface temperature of the toner image can be increased to a predetermined surface temperature with a smaller light amount in the glossiness control step.

Further, as shown in FIG. 6, preheating in the temperature control step can change the glossiness of the toner image to a predetermined glossiness with a smaller light amount. For example, in order to change the glossiness of the toner image to 40%, if the toner image is not heated (25° C.) in the temperature control step, the necessary light amount is about 7.9 J/cm$^2$, and if the toner image is heated to 40° C., 50° C., 60° C. and 75° C. in the temperature control step, the necessary light amount in the glossiness control step is about 7.0 J/cm$^2$, about 6.2 J/cm$^2$, about 5.6 J/cm$^2$ and about 5.1 J/cm$^2$, respectively. Thus, as the toner image is heated to a higher temperature in the temperature control step, the glossiness of the toner image can be changed to a predetermined glossiness with a smaller light amount in the glossiness control step.

It is preferable that the temperature control step be a step of fixing the toner image to the recording medium. Using the toner-image fixing step in which heating is performed as the temperature control step eliminates a need to separately provide a heating step after the fixing step. This can reduce the number of steps, and exhibit the effects of the present invention with a simpler method.

It is preferable that the temperature control step be a step of heating the toner image immediately before the glossiness control light is emitted to the toner image such that the toner image has a surface temperature which is 30° C. or higher and further preferably 40° C. or higher. Heating the toner image such that the toner image has a surface temperature which is higher than a room temperature (25° C.) by some degree can make the light amount to be emitted necessary to achieve desired glossiness smaller. This can make glossiness unevenness of the toner image after emission of the glossiness control light less than that of the toner image before emission thereof.

The temperature control step is a step of heating the toner image immediately before the glossiness control light is emitted to the toner image such that the toner image has a surface temperature which is at least 20° C. lower than the softening temperature of the toner. From the viewpoint of obtaining the effects of the present invention more effectively, it is preferable that this step be a step of heating the toner image such that the toner image has a surface temperature which is at least 30° C. lower than the softening temperature of the toner. The softening temperature of the toner can be measured, for example, with a flow tester as described below.

The measurement procedure of the softening temperature is as follows: place and flatten out 1.1 g of the toner in a Schale (petri dish) under the environment of a temperature of 20±1° C. and a relative humidity of 50±5%; leave the toner for 12 hours or more; apply a pressure of $3.75\times10^8$ Pa (3,820 kg/cm$^2$) to the toner for 30 seconds with a molding machine SSP-A (manufactured by Shimadzu Corporation), thereby producing a cylindrical molded sample having a diameter of 1 cm.

The measurement procedure of the softening temperature continues as follows: set the molded sample in a flow tester CFT-500D (manufactured by Shimadzu Corporation) under the environment of a temperature of 24±5° C. and a relative humidity of 50±20%; after preheating, extrude the molded sample from a hole (1 mm×1 mm) of a cylindrical die with a piston having a diameter of 1 cm with conditions of an applied load of 196 N (20 kgf), an initial temperature of 60° C., a preheating time of 300 seconds and a temperature rising rate of 6° C. per minute; and take, as the softening temperature of the toner, an offset method temperature T (offset) measured by a method of measuring a melting point while increasing temperature, setting an offset value at 5 mm.

It is preferable that the heating of the toner image in the temperature control step be performed on the entire toner image on the recording medium. Alternatively, the heating may be performed on only a portion of the toner image, the portion including a position on/to which light emission is performed, for example.

[Image Post-Processing Apparatus]

An image post-processing apparatus of the present invention is an image post-processing apparatus including: a glossiness control unit which, to a toner image(s) formed of a toner containing a light absorbing compound and fixed to a recording medium (media), emits glossiness control light having a maximum emission wavelength in a wavelength range in which the compound absorbs light and made to at least reduce glossiness of the toner image; and a temperature control unit which heats the toner image immediately before the glossiness control light is emitted to the toner image such that the toner image has a surface temperature which is at least 20° C. lower than a softening temperature of the toner.

Figure 7:
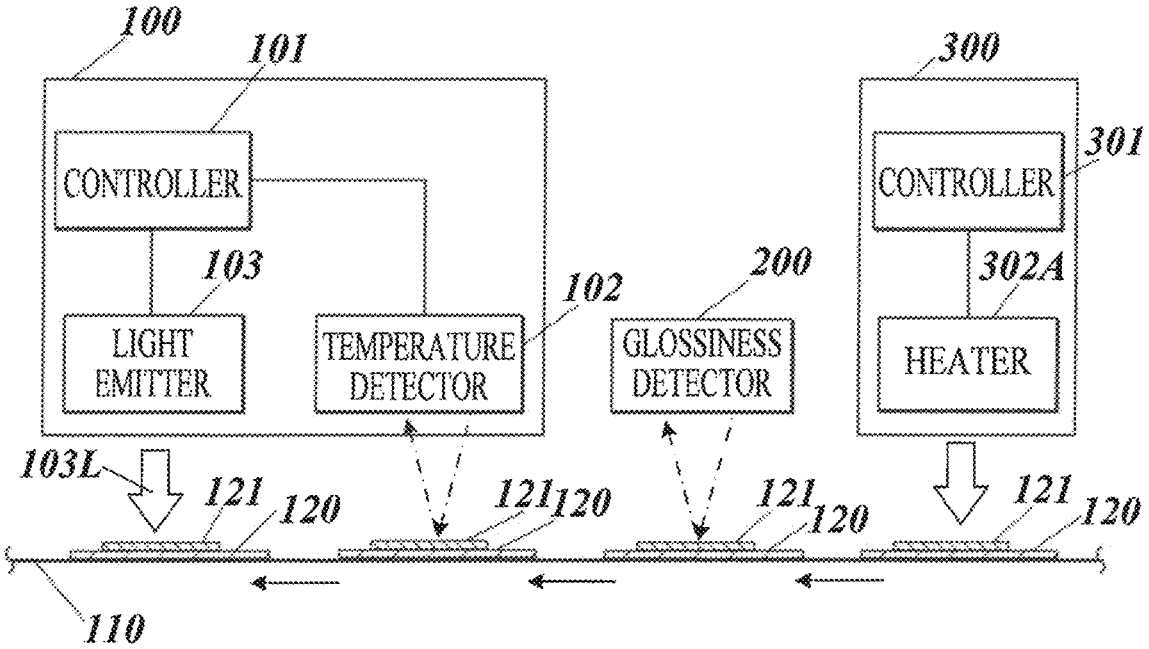
FIG. 7 is a schematic view showing an example of a glossiness control unit, a glossiness detector and a temperature control unit.
Figure 8:
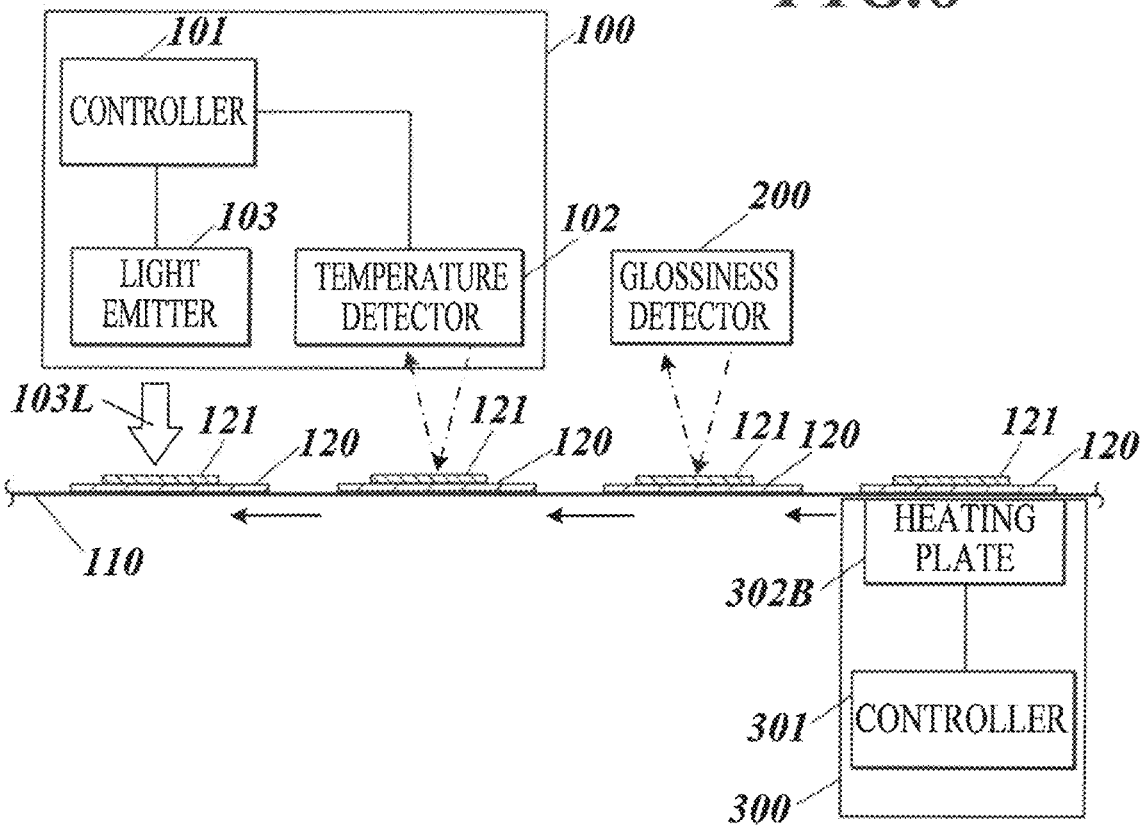
FIG. 8 is a schematic view showing another example of the glossiness control unit, the glossiness detector and the temperature control unit.
Figure 9:
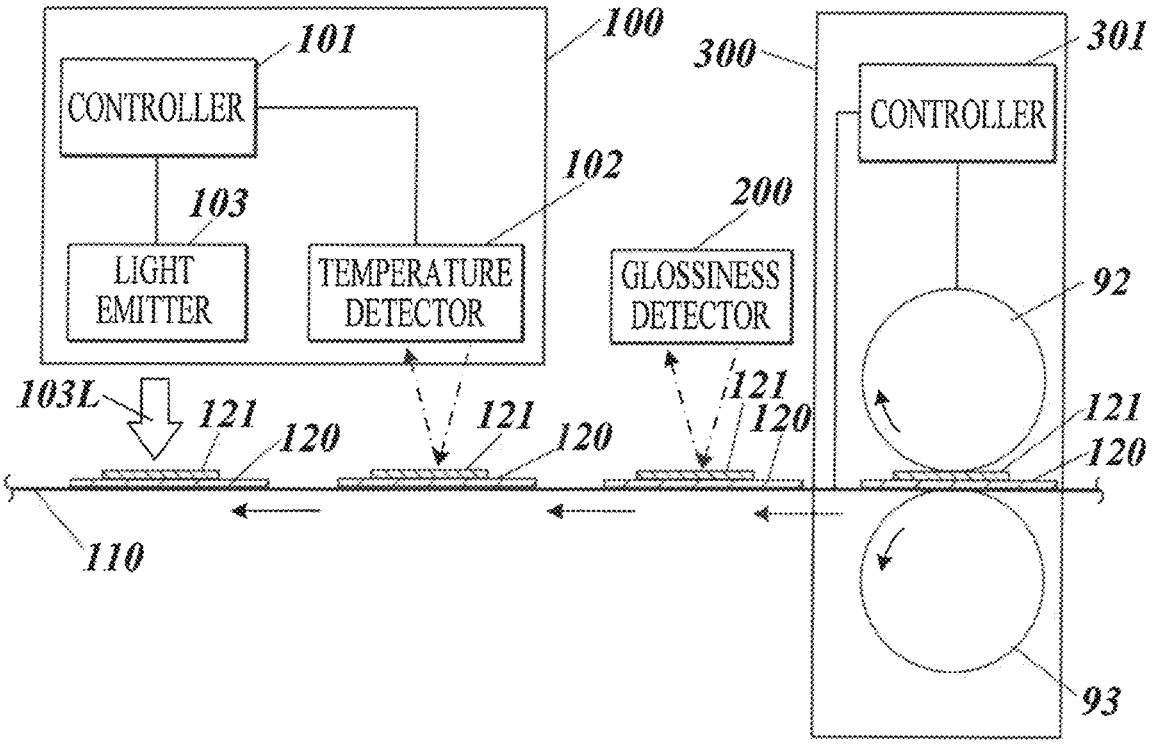
FIG. 9 is a schematic view showing another example of the glossiness control unit, the glossiness detector and the temperature control unit.

FIG. 7 to FIG. 9 show a glossiness control unit 100, a temperature control unit 300 and so forth of an image post-processing apparatus. FIG. 7 to FIG. 9 show examples, and not intended to limit the present invention. In FIG. 7 to FIG. 9, like components are given like reference numerals and names.

The glossiness control unit 100 includes the controller 101, the light emitter 103 and a temperature detector 102.

The controller 101 instructs the light emitter 103 on conditions including the amount of light to emit and the irradiation position with the light, and causes the light emitter 103 to emit light for controlling the glossiness (glossiness control light) 103L. If the temperature detector 102 obtains temperature information on a toner image before light emission, the controller 101 determines the condition(s), such as the light amount of the glossiness control light 103L, on the basis of the temperature information.

The temperature detector 102 measures (detects) the temperature of a toner image 121 before light emission when a recording medium 120 to which the toner image 121 is fixed is moved to the glossiness control unit 100 by a conveyor belt 110, and informs the controller 101 about the measured temperature information.

The light emitter 103 emits the glossiness control light 103L to the toner image 121 when the recording medium 120 to which the toner image 121 is fixed is moved to the glossiness control unit 100 by the conveyor belt 110.

The temperature control unit 300 includes a controller 301 (hardware processor) and a heating device. Examples of the heating device include, as a non-contact heating device, a heater 302A (shown in FIG. 7) such as an IR heater, and a heating plate 302B (shown in FIG. 8). In order to perform the heating simultaneously with the heating in the fixing step, a fixing roller 92 (shown in FIG. 9) may be made to function as the heating device.

First, an example of a case where the IR heater is used as the heating device will be described with reference to FIG. 7.

The controller 301 instructs the heater 302A (IR heater) on conditions including intensity of infrared rays to emit and an irradiation position with the infrared rays, and causes the heater 302A to emit the infrared rays.

The heater 302A emits the infrared rays to the toner image 121 when the recording medium 120 to which the toner image 121 is fixed is moved to the temperature control unit 300 by the conveyor belt 110. The toner image 121 heated by the heater 302A is immediately conveyed to the light emitter 103, and the light emitter 103 emits the glossiness control light 103L to the toner image 121.

Because it is preferable that the toner image 121 heated by the heater 302A be immediately conveyed to the light emitter 103, it is preferable that the distance between the light emitter 103 and the heater 302A be short.

The above is merely an example, and the arrangement of the heater 302A can be appropriately changed within a range with which the effects of the present invention can be obtained. For example, the heater 302A may be arranged such that the toner image 121 fixed to the recording medium 120 can be irradiated by the light emitter 103 while heated by the heater 302A.

Next, an example of a case where the heating plate 302B is used as the heating device will be described with reference to FIG. 8.

The controller 301 instructs the heating plate 302B on conditions including a heating temperature and a heating position, and causes the heating plate 302B to heat up (i.e. generate the heat).

The heating plate 302B heats the toner image 121 via the recording medium 120 from a side of the recording medium 120, the side where the toner image 121 is not formed, when the recording medium 120 to which the toner image 121 is fixed is moved to the temperature control unit 300 by the conveyor belt 110. The toner image 121 heated by the heating plate 302B is immediately conveyed to the light emitter 103, and the light emitter 103 emits the glossiness control light 103L to the toner image 121.

Because it is preferable that the toner image 121 heated by the heating plate 302B be immediately conveyed to the light emitter 103, it is preferable that the distance between the light emitter 103 and the heating plate 302B be short.

The above is merely an example, and the arrangement of the heating plate 302B can be appropriately changed within the range with which the effects of the present invention can be obtained. For example, the heating plate 302B may be arranged such that the toner image 121 fixed to the recording medium 120 can be irradiated by the light emitter 103 while heated by the heating plate 302B from the back side (the side where the toner image 121 is not formed/fixed) of the recording medium 120.

Next, an example of a case where the fixing roller 92 is used as the heating device will be described with reference to FIG. 9.

The controller 301 instructs the fixing roller 92 on a heating temperature condition to cause the fixing roller 92 to perform fixing at a predetermined temperature. The controller 301 instructs the conveyor belt 110 on a conveyance speed, and causes the conveyor belt 100 to change the conveyance speed. For example, the controller 301 instructs the conveyor belt 110 to speed up in order that after the toner image 121 is fixed to the recording medium 120 by the fixing roller 92 which has been heated to a predetermined temperature, the recording medium 120 is immediately conveyed to the light emitter 103. In this way, the recording medium 120 to which the heated toner image 121 is fixed is conveyed to the light emitter 103. Although the conveyor belt 110 speeds up in the above, what is necessary here is to increase the conveyance speed of the recording medium 120 (i.e. the toner image 121) between the fixing roller 92 and the light emitter 103.

Because it is preferable that the toner image 121 heated by the fixing roller 92 be immediately conveyed to the light emitter 103, it is preferable that the distance between the light emitter 103 and the fixing roller 92 be short.

Figure 10:
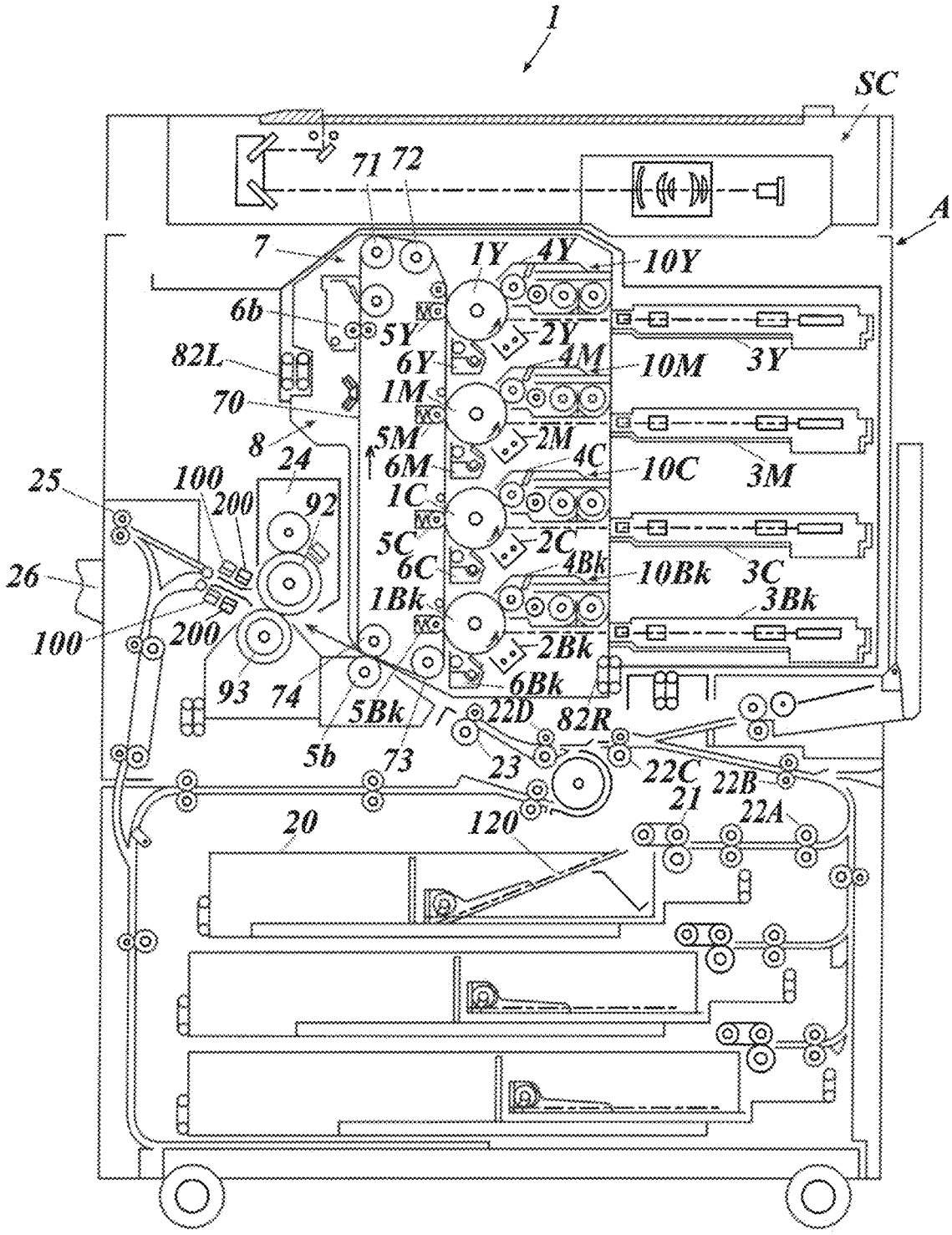
FIG. 10 is a schematic view showing schematic configuration of an image forming apparatus of the present invention as an example.

The fixing roller 92 is, as shown in FIG. 10, used in a fixing unit 24 of an electrophotographic image forming apparatus. As shown in FIG. 9, the fixing roller 92 and a pressure roller 93 are arranged so as to pinch the recording medium 120, and press and make the toner image 121 adhere to the recording medium 120. Heating the fixing roller 92 in advance can heat the toner image 121 at the time.

As another example of the case where the fixing roller 92 is used as the heating device, for example, the fixing roller 92 is installed right by the light emitter 103. In this way, the recording medium 120 to which the toner image 121 is fixed by the heated fixing roller 92 immediately reaches the light emitter 103, so that the toner image 121 in the heated state can be irradiated with the glossiness control light 103L emitted by the light emitter 103.

As shown in FIG. 7 to FIG. 9, it is preferable to arrange, between the temperature control unit 300 and the glossiness control unit 100, a glossiness detector 200 which detects the glossiness. This can detect (measure) the glossiness of the toner image 121 which is not yet irradiated with the glossiness control light 103L. Hence, the user can first check a numerical value of the measured glossiness, and then decide whether to reduce or increase the glossiness from the detected glossiness in the glossiness control unit 100.

It is also preferable to arrange the glossiness detector 200 on the downstream side of the glossiness control unit 100. This allows the user to check whether or not the glossiness has been adjusted to desired glossiness by emission of the glossiness control light 103L performed in the glossiness control unit 100. Also, the glossiness control unit 100 may emit the glossiness control light 103L again after the glossiness detector 200 detects the glossiness.

[Image Forming Method]

An image forming method of the present invention includes the glossiness control step described above. The glossiness control is performed on toner images fixed to recording media. The fixing step of fixing toner images to recording media according to the present invention can be performed on toner images transferred onto recording media in a transferring step via a charging step, an exposing step and a developing step of a known electrophotographic image forming method.

Hereinafter, these steps and a cleaning step which is performed after these steps will be described.

<Charging Step>

In this step, an electrophotographic photoreceptor is charged. The charging method is not particularly limited, and examples thereof include a charging method which uses a contact or non-contact roller(s).

<Exposing Step>

In this step, an electrostatic latent image is formed on the electrophotographic photoreceptor (an electrostatic latent image holding member).

The electrophotographic photoreceptor is not particularly limited, and examples thereof include a known drum-shaped organic photoreceptor.

The electrostatic latent image is formed, as described below, by charging the surface of the electrophotographic photoreceptor uniformly with a charger and exposing the surface of the electrophotographic photoreceptor imagewise with an exposure unit.

The exposure unit is not particularly limited, and examples thereof include an exposure unit constituted of LEDs of light emitting elements arrayed in the axial direction of the electrophotographic photoreceptor and imaging elements, and a laser optical system.

<Developing Step>

In this step, the electrostatic latent image is developed by a dry developer containing toner, so that a toner image is formed.

The toner image is formed by containing the dry developer containing the toner, for example, by a developing sleeve which has a built-in magnet and rotates while holding the developer and a voltage applier which applies direct and/or alternating current bias voltages to between the developing sleeve and the photoreceptor. More specifically, the toner and carrier are mixed and stirred, and the toner is charged by friction at the time and held on the surface of a rotating magnetic roller to form a magnetic brush. Because the magnetic roller is arranged near the electrophotographic photoreceptor, a part of the toner constituting the magnetic brush formed on the surface of the magnetic roller is transferred onto the surface of the electrophotographic photoreceptor by electrical attraction force. As a result, the electrostatic latent image is developed with the toner, so that the toner image is formed on the surface of the electrophotographic photoreceptor.

<Transferring Step>

In this step, the toner image is transferred onto a recording medium.

The toner image is transferred onto the recording medium by separation charging of the toner image to the recording medium.

Examples usable as the transfer unit include a corona transfer device with corona discharge, a transfer belt, and a transfer roller.

In the transferring step, for example, an intermediate transfer member may be used, and the toner image may be primary-transferred onto the intermediate transfer member and thereafter secondary-transferred onto the recording medium, or the toner image formed on the electrophotographic photoreceptor may be directly transferred onto the recording medium.

The recording medium is not particularly limited, and examples thereof include thin to thick plain paper, high quality paper, coated printing paper such as art paper and coated paper, commercially available Japanese paper and postcard paper, plastic films for OHP, and cloth.

<Fixing Step>

In this step, the toner image transferred onto the recording medium is fixed to the recording medium. More specifically, a unit employing a fixing-by-rollers system is used. This unit includes: a fixing roller; and a pressure roller arranged so as to form a fixing nip part by press-contacting the fixing roller.

The fixing roller may be used as the heating device. The toner image softened by irradiation is further softened by this heating, and fixability of the toner image to the recording medium is further improved.

Further, as described above, in the fixing step, the temperature control step of the present invention can be performed.

<Cleaning Step>

After the above steps, a cleaning step of removing the residual toner on the electrophotographic photoreceptors is performed.

In this step, a liquid developer which remains on developer holding members such as a developing roller(s), the photoreceptor and/or the intermediate transfer member by not being used in image forming or not being transferred is removed from the developer holding members.

The cleaning method is not particularly limited, but preferably a method using a blade which is arranged such that its tip abuts the photoreceptor and scrapes the surface of the photoreceptor. For example, a cleaner constituted of a cleaning blade and a brush roller arranged on the upstream side of the cleaning blade can be used.

[Image Forming Apparatus]

An image forming apparatus of the present invention is an image forming apparatus including: a transfer unit which transfers, onto a recording medium (media), a toner image(s) formed, in a developing unit, of a toner containing a light absorbing compound; a fixing unit which fixes the toner image to the recording medium; a glossiness control unit which, to the toner image fixed to the recording medium, emits glossiness control light having a maximum emission wavelength in a wavelength range in which the compound absorbs light and made to at least reduce glossiness of the toner image; and a temperature control unit which heats the toner image immediately before the glossiness control light is emitted to the toner image such that the toner image has a surface temperature which is at least 20° C. lower than a softening temperature of the toner.

Hereinafter, an example of the image forming apparatus applicable to the present invention will be described with reference to FIG. 10. The image forming apparatus shown in FIG. 10 uses the fixing roller 92 as the heating device in the temperature control unit 300 (shown in FIG. 9).

An image forming apparatus 1 shown in FIG. 10 is called tandem color image forming apparatus, and includes: four image forming units (process cartridges) 10Y, 10M, 10C, 10Bk; an endless-belt-shaped intermediate transfer member unit 7; a sheet feeder 21; and the fixing unit 24. On the upper side of a main body A of the image forming apparatus 1, a document image scanner SC is arranged.

Although FIG. 10 shows the image forming apparatus 1 having the four image forming units (process cartridges) 10Y, 10M, 10C, 10Bk, it may have only the image forming unit Bk, or at least two image forming units among the four image forming units (process cartridges) 10Y, 10M, 10C, 10Bk.

The image forming unit 10Y forms yellow images. The image forming unit 10Y includes: a drum-shaped electrophotographic photoreceptor 1Y; and a charger 2Y, an exposure unit 3Y, a developing unit 4Y and a cleaner 6Y which are arranged around the electrophotographic photoreceptor 1Y, and is provided with a primary transfer roller 5Y.

The image forming unit 10M forms magenta images. The image forming unit 10M includes: a drum-shaped electrophotographic photoreceptor 1M; and a charger 2M, an exposure unit 3M, a developing unit 4M and a cleaner 6M which are arranged around the electrophotographic photoreceptor 1M, and is provided with a primary transfer roller 5M.

The image forming unit 10C forms cyan images. The image forming unit 10C includes: a drum-shaped electrophotographic photoreceptor 1C; and a charger 2C, an exposure unit 3C, a developing unit 4C and a cleaner 6C which are arranged around the electrophotographic photoreceptor 1C, and is provided with a primary transfer roller 5C.

The image forming unit 10Bk forms black images. The image forming unit 10Bk includes: a drum-shaped electrophotographic photoreceptor 1Bk; and a charger 2Bk, an exposure unit 3Bk, a developing unit 4Bk and a cleaner 6Bk which are arranged around the electrophotographic photoreceptor 1Bk, and is provided with a primary transfer roller 5Bk.

The image forming units 10Y, 10M, 10C, 10Bk have the same configuration except the colors of the toner images formed on the electrophotographic photoreceptors 1Y, 1M, 1C, 1Bk. Hence, hereinafter the image forming unit 10Y will be described as an example.

In the embodiment(s), in the image forming unit 10Y, at least the electrophotographic photoreceptor 1Y, the charger 2Y, the developing unit 4Y and the cleaner 6Y are integrated.

The charger 2Y uniformly provides electric charge to the electrophotographic photoreceptor 1Y, thereby charging (e.g. negatively charging) the surface of the electrophotographic photoreceptor 1Y (e.g. the surface of a protective layer of the electrophotographic photoreceptor 1Y). The charger 2Y may charge the surface of the electrophotographic photoreceptor 1Y by a non-contact charging method, but preferably by a contact charging method as described below.

The exposure unit 3Y exposes the surface of the electrophotographic photoreceptor 1Y (e.g. the surface of the protective layer of the electrophotographic photoreceptor 1Y), which has been uniformly provided with the electric potential by the charger 2Y, on the basis of an image signal(s) (yellow), thereby forming an electrostatic latent image of a yellow image. Examples usable as the exposure unit 3Y include a unit constituted of LEDs of light emitting elements arrayed in the axial direction of the electrophotographic photoreceptor 1Y and imaging elements (product name SELFOC® lens (array)), and a laser optical system.

The developing unit 4Y develops the electrostatic latent image formed by the exposure unit 3Y with an electrostatic latent image developer, thereby forming a toner image. The electrostatic latent image developer to be used is not particularly limited, but preferably a dry developer.

In the image forming apparatus 1 of the embodiment(s), it is possible that the electrophotographic photoreceptor 1Y, the charger 2Y, the exposure unit 3Y, the developing unit 4Y and the cleaner 6Y are integrated as a process cartridge, and this process cartridge is detachably attached to the main body A. Alternatively, it is possible that at least one of the charger 2Y, the exposure unit 3Y, the developing unit 4Y, a transfer or releasing unit and the cleaner 6Y is integrated with and supported by the electrophotographic photoreceptor 1Y to constitute a process cartridge, this process cartridge is configured as a single image forming unit which can be detachably attached to the main body A, and this single image forming unit is detachably attached to the main body A by using a guiding device such as a rail(s) of the main body A.

A housing 8 houses the image forming units 10Y, 10M, 10C, 10Bk and the endless-belt-shaped intermediate transfer member unit 7. The housing 8 is configured to be drawn from the main body A along supporting rails 82L, 82R. In the housing 8, the image forming units 10Y, 10M, 10C, 10Bk are arranged tandem in the vertical direction. The endless-belt-shaped intermediate transfer member unit 7 is arranged on the left side of the electrophotographic photoreceptors 1Y, 1M, 1C, 1Bk in FIG. 10, and includes: a rotatable endless-belt-shaped intermediate transfer member 70 wound around rollers 71, 72, 73, 74; the primary transfer rollers 5Y, 5M, 5C, 5Bk; and a cleaner 6*b*.

The fixing unit 24 has a pressure applying unit which presses the toner image(s) formed on the recording medium 120.

The pressure applying unit includes the fixing roller 92 and the pressure roller 93. When the recording medium 120 having the toner image is fed, the fixing roller 92 and the pressure roller 93 press and make the toner image adhere to the recording medium 120.

The fixing roller 92 can heat the toner image on the recording medium 120 when the recording medium 120 passes through between the fixing roller 92 and the pressure roller 93. The toner image softened by irradiation is further softened by this heating. As a result, the fixability of the toner image to the recording medium 120 is further improved.

Further, as shown in FIG. 9, the fixing roller 92 in the fixing unit 24 is made to function as the heating device in the temperature control unit 300.

The temperature control unit 300 includes the controller 301, the fixing roller 92 as the heating device, and the pressure roller 93.

The controller 301 instructs the conveyor belt 110 on the conveyance speed, and causes the conveyor belt 110 to change the conveyance speed. For example, the controller 301 instructs the conveyor belt 110 to speed up in order that after the toner image 121 is fixed to the recording medium 120 by the fixing roller 92 which has been heated to a predetermined temperature, the recording medium 120 is immediately conveyed to the light emitter 103.

The glossiness control unit 100 includes the controller 101, the temperature detector 102 and the light emitter 103.

The controller 101 instructs the light emitter 103 on the conditions including the amount of light to emit and the irradiation position with the light, and causes the light emitter 103 to emit the glossiness control light 103L. If the temperature detector 102 obtains temperature information on the toner image before light emission, the controller 101 determines the conditions, such as the light amount of the glossiness control light 103L, on the basis of the temperature information.

The temperature detector 102 detects the temperature of the toner image 121 before light emission when the recording medium 120 to which the toner image 121 is fixed is moved to the glossiness control unit 100 by the conveyor belt 110, and informs the controller 101 about the detected temperature information.

The light emitter 103 emits the glossiness control light 103L to the toner image 121 when the recording medium 120 to which the toner image 121 is fixed is moved to the glossiness control unit 100 by the conveyor belt 110.

It is preferable to arrange, between the fixing unit 24 and the glossiness control unit 100, the glossiness detector 200 which detects the glossiness. This can detect (measure) the glossiness of the toner image which is not yet irradiated with the glossiness control light. Hence, the user can first check a numerical value of the measured glossiness, and then decide whether to reduce or increase the glossiness from the detected glossiness in the glossiness control unit 100.

Hereinafter, an image forming method using the image forming apparatus 1 shown in FIG. 10 will be described.

The images formed by the image forming units 10Y, 10M, 10C, 10Bk, respectively, are sequentially transferred onto the rotating endless-belt-shaped intermediate transfer member 70 by the primary transfer rollers 5Y, 5M, 5C, 5Bk, thereby forming a combined color image.

A recording medium 120 accommodated in a sheet feeding cassette 20 is fed by the sheet feeder 21 and conveyed to a secondary transfer roller 5*b* via multiple intermediate rollers 22A, 22B, 22C, 22D and registration rollers 23. The combined color image is secondary-transferred onto the recording medium 120 by the secondary transfer roller 5*b*. That is, the Y, M, C, Bk images are transferred onto the recording medium 120 collectively. When the combined color image is secondary-transferred onto the recording medium 120, the endless-belt-shaped intermediate transfer member 70 self-strips the recording medium 120.

In the fixing unit 24, the toner image (i.e. the combined color image) is fixed to the recording medium 120 by the fixing roller 92 and the pressure roller 93. At the time, the toner image to be fixed to the recording medium 120 is heated to the temperature at which the fixing can be performed.

The recording medium 12 having passed through the fixing unit 24 is immediately conveyed to the glossiness control unit 100 by the conveyor belt 110. When the recording medium 120 is conveyed to (i.e. reaches) the glossiness control unit 100, the toner image fixed to the recording medium 120 has a surface temperature which is at least 20° C. lower than the softening temperature of the toner constituting the toner image. In the glossiness control unit 100, the glossiness control light is emitted to the recording medium 120 to which the toner image is fixed, so as to reduce or increase the glossiness of the toner image.

The image-post-processed recording medium 120 is pinched by sheet ejecting rollers 25 and placed on a sheet receiving tray 26 provided outside of the apparatus. The electrostatic latent image developer (residual toner) adhering to the intermediate transfer member 70 is removed by the cleaner 6*b*.

During image forming, the primary transfer roller 5Bk always abuts the surface of the electrophotographic photoreceptor 1Bk. Meanwhile, the primary transfer rollers 5Y, 5M, 5C abut the surfaces of their corresponding electrophotographic photoreceptors 1Y, 1M, 1C only during color image forming. The secondary transfer roller 5*b* abuts the surface of the endless-belt-shaped intermediate transfer member 70 only at the time of secondary transfer, namely, at the time when recording media 120 pass the secondary transfer roller 5*b*.

[Image Forming Apparatus to Which Image Post-processing Apparatus is Attached]

An image forming apparatus of the present invention may be an image forming apparatus including: a transfer unit which transfers, onto a recording medium (media), a toner image(s) formed, in a developing unit, of a toner containing a light absorbing compound; and a fixing unit which fixes the toner image to the recording medium, wherein the image post-processing apparatus, which includes the glossiness control unit 100 and the temperature control unit 300, of the present invention is attached to the image forming apparatus.

[Toner (Toner for Developing Electrostatic Latent Image)]

In the image post-processing method of the present invention, a toner containing a light absorbing compound (toner for developing electrostatic latent images) is used.

It is preferable that the toner according to the present invention be an assembly of toner base particles or toner particles.

Herein, the toner particles are the toner base particles with an external additive added. The toner base particles may be used as the toner particles as they are.

<Light Absorbing Compound>

The light absorbing compound contained in the toner is preferably a compound which absorbs light in the wavelength range of 280 nm to 850 nm.

In the present invention, the "compound which absorbs light in the wavelength range of 280 nm to 850 nm" is a compound having an absorbance of 0.01 or more at an arbitrary wavelength in the wavelength range of 280 nm to 850 nm, wherein the absorbance is obtained by dissolving the compound in a solvent (e.g. DMF, THF, chloroform, etc.) at a concentration of 0.01 mass % and measuring the absorbance with a spectrophotometer.

Preferable examples of the compound which absorbs light in the wavelength range of 280 nm to 850 nm contained in the toner used in the present invention include colorants of black, yellow, magenta and cyan, and an UV absorber. The toner used in the present invention may contain one kind of the compound which absorbs light in the wavelength range of 280 nm to 850 nm, or may contain two or more kinds thereof.

<Colorant>

Preferably, the toner particles according to the present invention contain a colorant as the above light absorbing compound. Usable examples of the colorant include generally known dyes and pigments.

Examples of the colorant to obtain a black toner include carbon black, a magnetic material, and iron-titanium complex oxide black.

Examples of the carbon black include channel black, furnace black, acetylene black, thermal black, and lamp black. Examples of the magnetic material include ferrite and magnetite.

Examples of the colorant to obtain a yellow toner include: dyes such as C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, and C.I. Solvent Yellow 162; and pigments such as C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, and C.I. Pigment Yellow 185.

Examples of the colorant to obtain a magenta toner include: dyes such as C.I. Solvent Red 1, C.I. Solvent Red 49, C.I. Solvent Red 52, C.I. Solvent Red 58, C.I. Solvent Red 63, C.I. Solvent Red 111, and C.I. Solvent Red 122; and pigments such as C.I. Pigment Red 5, C.I. Pigment Red 48:1, C.I. Pigment Red 53:1, C.I. Pigment Red 57:1, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Examples of the colorant to obtain a cyan toner include: dyes such as C.I. Solvent Blue 25, C.I. Solvent Blue 36, C.I. Solvent Blue 60, C.I. Solvent Blue 70, C.I. Solvent Blue 93, and C.I. Solvent Blue 95; and pigments such as C.I. Pigment Blue 1, C.I. Pigment Blue 7, C.I. Pigment Blue 15, C.I. Pigment Blue 15:3, C.I. Pigment Blue 60, C.I. Pigment Blue 62, C.I. Pigment Blue 66, and C.I. Pigment Blue 76.

As the colorant to obtain each color, for each color, one kind of the colorant or two or more kinds thereof combined can be used.

The content ratio of the colorant to the total mass (100 mass %) of the toner particles is preferably in a range of 1 to 30 mass % and further preferably in a range of 2 to 20 mass %. If the content ratio is 1 mass % or more, sufficient coloring power can be obtained, whereas if the content ratio is 30 mass % or less, high quality images can be obtained because the colorant does not separate from the toner to adhere to the carrier, and chargeability of the toner becomes stable.

<UV (Ultraviolet) Absorber>

The toner particles according to the present invention preferably contain the UV absorber as the above light absorbing compound.

The UV absorber in the present invention is an additive which has an absorbance wavelength in a wavelength range of 180 to 400 nm, and is deactivated from an excited state by non-radiative deactivation without structure change such as isomerization or bond cleavage, at least under the environment where the temperature is 0° C. or more. The UV absorber may be an organic compound or an inorganic compound as far as it satisfies the above conditions, and other than a common organic UV absorber, additives such as a light stabilizer and antioxidant are in the scope of the UV absorber in the present invention.

Further, UV absorbing polymer having a polymer chain including functional groups having an organic UV absorber skeleton can also be used.

It is preferable that the UV absorber have the maximum absorption wavelength in a range of 180 to 400 nm. Further, an organic UV absorber is preferred to an inorganic UV absorber.

Examples of the organic UV absorber usable in the present invention include known organic UV absorbers such as a benzophenone UV absorber, a benzotriazole UV absorber, a triazine UV absorber, a cyanoacrylate UV absorber, a salicylate UV absorber, a benzoate UV absorber, a diphenylacrylate UV absorber, a benzoic acid UV absorber, a salicylic acid UV absorber, a cinnamic acid UV absorber, a dibenzoylmethane UV absorber, a β,β-diphenylacrylate UV absorber, a benzylidene camphor UV absorber, a phenyl benzimidazole UV absorber, an anthranil UV absorber, an imidazoline UV absorber, a benzalmalonate UV absorber, and a 4,4-diaryl butadiene UV absorber. Among these, a benzophenone UV absorber, a benzotriazole UV absorber, a triazine UV absorber, a cyanoacrylate UV absorber, and a dibenzoylmethane UV absorber are preferable.

The above may be used alone or in combinations of two or more kinds.

Examples of the benzophenone UV absorber (UV absorber containing a benzophenone compound) include octabenzone, 2,4-hydroxybenzophenone, 2-hydroxy-4-methoxybenzophenone, and 2-hydroxy-4-n-octyloxybenzophenone.

Examples of the benzotriazole UV absorber (UV absorber containing a benzotriazole compound) include 2-(2p-cresol, 2-(2H-benzotriazole-2-yl)-4,6-bis(1-methyl-1-phenylethyl) phenol, 2-[5-chloro(2H)-benzotriazole-2-yl]-4-methyl-6-(tert-butyl)phenol, 2-(2H-benzotriazole-2-yl)-4,6-di-tert-pentylphenol, 2-(2H-benzotriazole-2-yl)-4-(1,1,3,3-tetramethylbutyl)phenol, reaction products of methyl-3-[3-t-butyl-5-(2H-benzotriazole-2-yl)-4-hydroxyphenyl]propionate/ polyethylenglycol (molecular weight: about 300), 2-(2H-benzotriazole-2-yl)-6-dodecyl-4-methylphenol, 2-(2-hydroxy-5-tert-butylphenyl)-2H-benzotriazole, 2-ethylhexyl-3-[3-tert-butyl-4-hydroxy-5-(5-chloro-2H-benzotriazole-2-yl) phenyl]propionate, 2-(2H-benzotriazole-2-yl)-4,6-bis(1-methyl-1-phenylethyl)phenol, and 2-(2H-benzotriazole-2-yl)-6-(1-methyl-1-phenylethyl)-4-(1,1,3,3-tetramethylbutyl) phenol.

Examples of the triazine UV absorber (UV absorber containing a triazine compound) include 2-(4,6-bis(2,4-dimethylphenyl)-1,3,5-triazin-2-yl)-5-hydroxyphenyl, 2-(4,6-diphenyl-1,3,5-triazin-2-yl)-5-[(hexyl)oxy]phenol, 2-[4-[(2-hydroxy-3-dodecyloxypropyl)oxy]-2-hydroxyphenyl]-4,6-bis(2,4-dimethylphenyl)-1,3,5-triazine, 2-[4-[(2-hydroxy-3-(2'-ethyl)hexyl)oxy]-2-hydroxyphenyl]-4,6-bis(2,4-dimethylphenyl)-1,3,5-triazine, 2,4-bis(2-hydroxy-4-butyloxyphenyl)-6-(2,4-bis-butyloxyphenyl)-1,3,5-triazine, and 2-(2-hydroxy-4-[1-octyloxycarbonylothoxy]phenyl)-4,6-bis(4-phenyl)-1,3,5-triazine.

Examples of the cyanoacrylate UV absorber (UV absorber containing a cyanoacrylate compound) include ethyl2-cyano-3,3-diphenylacrylate and 2'-ethylhexyl2-cyano-3,3-diphenylacrylate.

Examples of the dibenzoylmethane UV absorber (UV absorber containing a dibenzoylmethane compound) include 4-tert-butyl-4'-methoxydibenzoylmethane (e.g. PARSOL® 1789 manufactured by DSM).

Examples of the inorganic UV absorber include titanium oxide, zinc oxide, cerium oxide, iron oxide, and barium sulfate. It is preferable that the particle diameter (size) of the inorganic UV absorber be in a range of 1 nm to 1 nm.

The content ratio of the UV absorber to the total mass (100 mass %) of the toner particles is in a range of 0.1 to 50 mass %. If the content ratio is less than 0.1 mass %, sufficient heat (energy) cannot be obtained, whereas if the content ratio is more than 50 mass %, fixed images easily peel off.

The content ratio of the UV absorber is preferably in a range of 0.5 to 35 mass %. If the content ratio is 0.5 mass % or more, obtained heat energy becomes so large that the fixability is further improved, whereas if the content ratio is 35 mass % or less, the ratio of resin becomes so large that images are strongly fixed and the fixability is further improved.

The toner particles of the present invention contain a binder resin, a releasing agent, a charge control agent and so forth, preferably with an external additive added. Hereinafter, these will be described.

<Binder Resin>

The binder resin preferably contains an amorphous resin and a crystal (crystalline) resin.

The toner particles according to the present invention contain the binder resin, so that the toner has a proper viscosity, and suppress bleeding when applied to paper. This can improve reproducibility of thin lines and reproducibility of dots.

As the binder resin, any resin generally used as a binder resin which constitutes toner particles can be used without limitation. Specific examples thereof include styrene resin, acrylic resin, styrene-acrylic resin, polyester resin, silicone resin, olefin resin, amide resin, and epoxy resin. These binder resins may be used alone or in combinations of two or more kinds.

Among these resins, because they become low viscosity when melted and have highly sharp meltability, it is preferable that the binder resin contain at least one kind selected from a group consisting of styrene resin, acrylic resin, styrene-acrylic resin and polyester resin, and far preferable that the binder resin contain at least one kind selected from a group consisting of styrene-acrylic resin and polyester resin.

A glass transition temperature (Tg) of the binder resin is preferably in a range of 35 to 70° C. and further preferably in a range of 35 to 60° C. from the viewpoint of the fixability and heat-resistant storage properties. The glass transition temperature (Tg) can be measured with differential scanning colorimetry (DSC).

It is preferable that the toner according to the present invention contain crystalline polyester resin as the crystal resin used in the binder resin from the viewpoint of improving the fixability of the toner at a low temperature (hereinafter "low-temperature fixability). From the viewpoint of further improving the low-temperature fixability of the toner, it is preferable that the toner contain, as the crystalline polyester resin, hybrid crystalline polyester resin constituted of a crystalline polyester resin segment binding with an amorphous resin segment. As the crystalline polyester resin and the hybrid crystalline polyester resin, known compounds described, for example, in JP 2017-37245 A can be used.

The toner particles containing the binder resin may have a single-layer structure or a core-shell structure. Any kind of binder resin can be used for core particles and a shell layer in the core-shell structure without particular limitation.

<Releasing Agent>

The toner particles according to the present invention may contain the releasing agent. The releasing agent to be used is not particularly limited, and various known waxes can be used.

Examples of the wax(es) include: polyolefin such as low molecular weight polypropylene, polyethylene, oxidized low molecular weight polypropylene, and oxidized polyethylene; paraffin; and synthetic ester wax.

It is preferable to use synthetic ester wax due to its low melting point/temperature and low viscosity, in particular, behenyl behenate, glycerin tribehenate, or pentaerythritol tetrabehenate.

The content ratio of the releasing agent to the total mass (100 mass %) of the toner particles is preferably in a range of 1 to 30 mass % and further preferably in a range of 3 to 15 mass %.

<Charge Control Agent>

The toner particles according to the present invention may contain the charge control agent. The charge control agent to be used is not particularly limited as far as it is a substance which is colorless and capable of positively or negatively charging the toner particles by triboelectric charging, and various known positively chargeable charge control agents and negatively chargeable charge control agents can be used.

The content ratio of the charge control agent to the total mass (100 mass %) of the toner particles is preferably in a range of 0.01 to 30 mass % and further preferably in a range of 0.1 to 10 mass %.

<External Additive>

In order to improve fluidity, chargeability, and cleanability/removability of the toner, the external additive such as a fluidizer and/or a cleaning assisting agent, which are called after-treatment agent, may be added onto the surface of the toner base particles.

Examples of the external additive include inorganic particles exemplified by: inorganic oxide particles such as silica particles, alumina particles, and titanium oxide particles; inorganic stearic acid compound particles such as aluminum stearate particles and zinc stearate particles; and inorganic titanium acid compound particles such as strontium titanate particles and zinc titanate particles.

These may be used alone or in combinations of two or more kinds.

From the viewpoint of improving the heat-resistant storage properties and environmental stability, these inorganic particles may be surface-modified by a silane coupling agent, a titanium coupling agent, a higher aliphatic acid, a silicone oil or the like.

The added amount of the external additive to the total mass (100 mass %) of the toner particles is preferably in a range of 0.05 to 5 mass % and further preferably in a range of 0.1 to 3 mass %.

<Average Particle Diameter of Toner Particles>

The toner particles have the average particle diameter preferably in a range of 4 to 10 μm and further preferably in a range of 4 to 7 μm in volume-based median diameter (D50). If the volume-based median diameter (D50) is in the abovementioned range, transfer efficiency is increased, quality of halftone images is improved, and image quality of thin lines, dots and so forth is improved.

The volume-based median diameter (D50) of the toner particles is measured and calculated with a measuring device constituted of COULTER COUNTER 3 (manufactured by Beckman Coulter Inc.) and a computer system equipped with data processing software Software V3.51 (manufactured by Beckman Coulter Inc.) connected thereto.

More specifically, the measurement and calculation are performed as follows: add and well disperse 0.02 g of a measurement sample (toner) into 20 mL of a surfactant solution (e.g. a surfactant solution of a surfactant component-containing neutral detergent diluted 10 times with pure water for dispersing toner particles) and then perform ultrasonic dispersion for one minute so as to prepare a toner particle dispersion; and pour this toner particle dispersion into a beaker containing ISOTON II (manufactured by Beckman Coulter, Inc.) in a sample stand with a pipette until the displayed concentration of the measuring device reaches 8%.

Setting this content range can generate a reproducible measurement value. The measurement and calculation are further performed as follows: set a measurement particle counting number and an aperture diameter in the measuring device at 25,000 and 50 μm, respectively; calculate frequency values with a range of 1 to 30 μm as a measurement range divided into 256 segments; and take the particle diameter at 50% in volume-based cumulative fractions from the largest as the volume-based median diameter (D50).

<Toner Producing Method>

A method for producing toner (hereinafter "toner producing method") according to the present invention can be any known method without particular limitation, but preferably an emulsion polymerization coagulation method or an emulsion coagulation method. Hereinafter, an example of the toner producing method of toner particles containing particles of an UV absorber and a colorant will be described.

The emulsion polymerization coagulation method is a method for producing toner particles, including: mixing a dispersion of particles of a binder resin (hereinafter may be referred to as "binder resin particles) produced by an emulsion polymerization method with a dispersion of particles of an UV absorber (hereinafter may be referred to as "UV absorber particles), a dispersion of particles of a colorant (hereinafter may be referred to as "colorant particles") and a dispersion of a releasing agent such as wax; coagulating these until toner particles have a desired diameter; and fusing the binder resin particles, thereby controlling the shape.

The emulsion coagulation method is a method for producing toner particles, including: dropping a binder resin solution dissolved in a solvent to a poor solvent, thereby preparing a resin particle dispersion; mixing the resin particle dispersion with a UV absorber particle dispersion, a colorant particle dispersion, and a releasing agent dispersion of a releasing agent such as wax; and coagulating these until toner particles have a desired diameter; and fusing the binder resin particles, thereby controlling the shape.

The toner in the present invention can be produced by either method.

A case where the emulsion polymerization coagulation method is used as the toner producing method according to the present invention will be described below.

The method includes:

(1) a step of preparing a dispersion in which colorant particles are dispersed in an aqueous medium;

(2) a step of preparing a dispersion in which UV absorber particles are dispersed in an aqueous medium;

(3) a step of preparing a dispersion in which binder resin particles containing an internal additive as needed are dispersed in an aqueous medium;

(4) a step of preparing a dispersion of binder resin particles by emulsion polymerization;

(5) a step of forming toner base particles by mixing the colorant particle dispersion, the UV absorber particle dispersion, and the binder resin particle dispersion, thereby coagulating, associating, and fusing the colorant particles, the UV absorber particles, and the binder resin particles;

(6) a step of removing a surfactant and so forth by filtering the toner base particles from a dispersion system (aqueous medium) of the toner base particles;

(7) a step of drying the toner base particles; and (8) a step of adding an external additive to the toner base particles.

In the case where the emulsion polymerization coagulation method is used as the toner producing method, the binder resin particles obtained by the emulsion polymerization method may have a multilayer structure of two or more layers composed of binder resins different in composition. The binder resin particles having, for example, a two-layer structure can be obtained by a method of: preparing the resin particle dispersion by emulsion polymerization (first polymerization) in accordance with a usual method; adding a polymerization initiator and a polymerizable monomer to the dispersion; and polymerizing (second polymerization) this system.

Toner particles having a core-shell structure can be obtained by the emulsion polymerization coagulation method. More specifically, the toner particles having a core-shell structure can be obtained by: first, preparing core particles by coagulating, associating, and fusing binder resin particles, UV absorber particles, and colorant particles for core particles; and subsequently, adding binder resin particles for a shell layer into a dispersion of the core particles so as to coagulate and fuse the binder resin particles for the shell layer on the surface of the core particles, thereby forming the shell layer with which the surface of the core particles is coated.

<Developer>

The toner according to the present invention may be used as a magnetic single-component toner containing a magnetic material, a two-component developer with, what is called, a carrier mixed, or a nonmagnetic toner alone, any of which can be suitably used in the present invention.

Usable examples of the magnetic material include magnetite, γ-hematite, and various kinds of ferrite.

The carrier in the two-component developer is, for example, magnetic particles of a conventionally known material. Usable examples thereof include: metals such as iron, steel, nickel, cobalt, ferrite, and magnetite; and alloys of these metals with other metals such as aluminum and lead.

Preferably usable examples of the carrier include a coated carrier containing magnetic particles the surface of which is coated with a coating agent such as resin, and, what is called, a resin-dispersed carrier containing magnetic material powder dispersed in a binder resin. The resin for coating is not particularly limited, and examples thereof include olefin resin, styrene resin, styrene-acrylic resin, silicone resin, polyester resin, and fluororesin. Further, the resin for constituting the resin-dispersed carrier is not particularly limited, and usable examples thereof include known resins such as acrylic resin, styrene-acrylic resin, polyester resin, fluororesin, and phenol resin.

The volume-based median diameter of the carrier is preferably in a range of 20 μm to 100 μm and far preferably in a range of 25 μm to 80 μm. The volume-based median diameter of the carrier can be measured, for example, with a laser diffraction particle size analyzer HELOS (manufactured by Sympatec Inc.) provided with a wet-type disperser.

The mixed amount of the toner to the carrier is, taking the total mass of the toner and the carrier as 100 mass %, preferably in a range of 2 to 10 mass %.

EXAMPLES

Hereinafter, the present invention will be more specifically described with Examples. However, the present invention is not limited thereto.

[Toner Producing Method]

<Synthesis of Crystalline Polyester 1>

The following raw material monomers for an addition polymerization resin (styrene-acrylic resin: StAc) unit including a bireactive monomer and a radical polymerization initiator were put in a dropping funnel.

| | |
|---|---|
| styrene | 34 parts by mass |
| n-butyl acrylate | 12 parts by mass |
| acrylic acid | 2 parts by mass |
| polymerization initiator (di-t-butylperoxide) | 7 parts by mass |

The following raw material monomers for a polycondensation resin (crystalline polyester resin: CPEs) unit were put in a four-necked flask equipped with a nitrogen introducing tube, a dehydration tube, a stirrer, and a thermocouple, and heated to 170° C. to be dissolved.

| | |
|---|---|
| sebacic acid | 281 parts by mass |
| 1,12-dodecanediol | 283 parts by mass |

Subsequently, the raw material monomers for the addition polymerization resin (StAc), which had been put in the dropping funnel, were dropped in the four-necked flask while stirred over 90 minutes, and the mixture was aged for 60 minutes. Thereafter, the unreacted raw material monomers for the addition polymerization resin were removed under a reduced pressure of 8 kPa. The amount of the removed monomers was very small compared to the amount of the raw material monomers for the abovementioned resin.

Thereafter, 0.8 parts by mass of $Ti(OBu)_4$ were poured as an esterification catalyst, and the mixture was heated to 235° C., reacted under a normal pressure of 101.3 kPa for five hours, and then further reacted under a reduced pressure of 8 kPa for one hour.

Next, after cooled to 200° C., the mixture was reacted under a reduced pressure of 20 kPa for one hour. Thus, crystalline polyester 1, which is the hybrid crystalline polyester resin, was produced. The crystalline polyester 1 contained, to the total amount, 8 mass % of the resin (StAc) unit other than CPEs, and was resin having a structure in which CPEs was grafted on StAc. The crystalline polyester 1 had a number average molecular weight (Mn) of 9,000 and a melting temperature (Tc) of 75° C.

<Preparation of Crystalline Resin Particle Dispersion (C1)>

30 parts by mass of the crystalline polyester 1 were melted, and the crystalline polyester 1 was transferred in this melted state to an emulsion disperser Cavitron CD1010 (manufactured by Eurotech Co., Ltd.) at a transfer speed of 100 parts by mass per minute. Simultaneously with the transfer of the crystalline polyester 1 in the melted state, diluted ammonia water having a concentration of 0.37 mass % composed of 70 parts by mass of reagent ammonia water diluted with ion exchanged water in an aqueous solvent tank was transferred to the emulsion disperser Cavitron CD1010 (manufactured by Eurotech Co., Ltd.) at a transfer speed of 0.1 L/min while heated to 100° C. with a heat exchanger. This emulsion disperser Cavitron CD1010 (manufactured by Eurotech Co., Ltd.) was operated under the conditions of a rotor's rotational speed of 60 Hz and a pressure of 5 kg/cm$^2$. Thus, a crystalline resin particle dispersion (C1) of the crystalline polyester 1 having a solid content of 30 parts by mass was prepared. The particles contained in the crystalline resin particle dispersion (C1) had a volume-based median diameter of 200 nm.

<Preparation of Amorphous Resin Particle Dispersion (X1)>

(1) First Polymerization

Into a 5 L reaction vessel equipped with a stirrer, a temperature sensor, a cooling tube, and a nitrogen introducing device, 8 parts by mass of sodium dodecyl sulfate and 3,000 parts by mass of ion exchanged water were fed. While the solution was stirred at a stirring speed of 230 rpm under a nitrogen flow, the inner temperature of the reaction vessel was raised to 80° C. After the temperature was raised, a solution of 10 parts by mass of potassium persulfate dissolved in 200 parts by mass of ion exchanged water was added thereto, the liquid temperature was made to be 80° C. again, and a monomer mixture solution having the following composition was dropped thereto over one hour. After the dropping, the resulting solution was heated and stirred at 80° C. for two hours to carry out polymerization. Thus, a resin particle dispersion (x1) was prepared.

| | |
|---|---|
| styrene | 480 parts by mass |
| n-butyl acrylate | 250 parts by mass |
| methacrylic acid | 68 parts by mass |

(2) Second Polymerization

Into a 5 L reaction vessel equipped with a stirrer, a temperature sensor, a cooling tube, and a nitrogen introducing device, a solution of 7 parts by mass of polyoxyethylene-2-dodecyl ether sodium sulfate dissolved in 3,000 parts by mass of ion exchanged water was fed. After the solution was heated to 98° C., 260 parts by mass of the resin particle dispersion (x1) and a solution of the following monomers and releasing agent dissolved at 90° C. were added, and mixed and dispersed for one hour with a mechanical disperser having a circulation route CLEARMIX (manufactured by M Technique Co., Ltd.). Thus, a dispersion containing emulsion particles (oil droplets) was prepared.

| | |
|---|---|
| styrene (St) | 284 parts by mass |
| n-butyl acrylate (BA) | 92 parts by mass |
| methacrylic acid (MAA) | 13 parts by mass |
| n-octyl-3-mercaptopropionate | 1.5 parts by mass |
| releasing agent (behenyl behenate; melting temperature of 73° C.) | 190 parts by mass |

Subsequently, to this dispersion, an initiator solution of 6 parts by mass of potassium persulfate dissolved in 200 parts by mass of ion exchanged water was added, and the system was heated and stirred at 84° C. for one hour to carry out polymerization. Thus, a resin particle dispersion (x2) was prepared.

(3) Third Polymerization

To the resin particle dispersion (x2), 400 parts by mass of ion exchanged water were added and mixed. Thereafter, a solution of 11 parts by mass of potassium persulfate dissolved in 400 parts by mass of ion exchanged water was added thereto. Then, under the temperature condition of 82° C., a monomer mixture solution having the following composition was dropped thereto over one hour. After the dropping, the resulting solution was heated and stirred for two hours to carry out polymerization, and then cooled to 28° C. Thus, an amorphous resin particle dispersion (X1) of vinyl resin (styrene-acrylic resin 1) was prepared.

| | |
|---|---|
| styrene (St) | 350 parts by parts |
| n-butyl acrylate (BA) | 215 parts by mass |
| acrylic acid (AA) | 30 parts by mass |
| n-octyl-3-mercaptopropionate | 8 parts by mass |

Physical properties of the obtained amorphous resin particle dispersion (X1) were measured. The amorphous resin particles had a volume-based median diameter of 220 nm, a glass transition temperature (Tg) of 55° C. and a weight average molecular weight (Mw) of 32,000.

<Preparation of Black Colorant Particle Dispersion [Bk]>

90 parts by mass of sodium dodecyl sulfate were stirred and dissolved in 1,600 parts by mass of ion exchanged water. While this solution was stirred, 420 parts by mass of carbon black REGAL 330R (manufactured by Cabot Corp.) were gradually added thereto, and subsequently dispersed with a dispersion machine CLEARMIX (manufactured by M Technique Co., Ltd.). Thus, a black colorant particle dispersion [Bk] of black colorant particles dispersed was prepared. The volume-based median diameter of the black colorant particles in the black colorant particle dispersion [Bk] was measured with an electrophoretic light scattering photometer ELS-800 (manufactured by Otsuka Electronics Co., Ltd.), and it was 120 nm.

<Production of Toner T1>

Into a reaction vessel equipped with a stirrer, a temperature sensor and a cooling tube, 195 parts by mass (in terms of solid content) of the amorphous resin particle dispersion (X1) and 2,000 parts by mass of ion exchanged water were poured. Thereafter, a 5 mol/L sodium hydroxide aqueous solution was added to adjust pH to 10 at 30° C.

To the pH-adjusted amorphous resin particle dispersion (X1), 40 parts by mass (in terms of solid content) of the black colorant particle dispersion [Bk] were poured. Subsequently, while stirred, an aqueous solution of 30 parts by mass of magnesium chloride as a coagulant dissolved in 60 parts by mass of ion exchanged water was added at 30° C. over 10 minutes. The temperature of this mixed liquid was raised to 60° C. at a temperature rise rate of 0.8° C. per minute, and 20 parts by mass of the crystalline resin particle dispersion (C1) of the crystalline polyester 1 were added thereto over 10 minutes. Further, the temperature thereof was raised to 80° C. at a temperature rise rate of 0.8° C. per minute. The temperature was kept at 80° C. to advance coagulation of the particles, and the particle diameter of the associated particles was measured with Multisizer 3 (manufactured by Beckman Coulter, Inc.). When the volume-based median diameter thereof reached 6.0 μm, an aquous solution of 190 parts by mass of sodium chloride dissolved in 760 parts by mass of ion exchanged water was added to stop the particle growth. Further, the resulting solution was heated and stirred at 80° C. to advance fusion of the particles. When the average circularity (HPF detection of 4,000 particles) measured with a measuring device FPIA-2100 (manufactured by Sysmex Co.) reached 0.945, the solution was cooled to 30° C. at a cooling rate of 2.5° C. per minute.

The volume-based median diameter of the coagulated particles in the mixed liquid at the time of addition of the crystalline resin particle dispersion (C1) was 0.80 μm. The volume-based median diameter was obtained by calculating the volume mean particle diameter with UPA-150 (manufactured by MicrotracBEL Corp.).

Subsequently, a toner cake obtained by solid-liquid separation and dehydration was washed by repeating a process of re-dispersion in ion exchanged water and solid-liquid separation three times, and thereafter dried at 40° C. for 24 hours. Thus, toner particles were obtained.

To 100 parts by mass of the obtained toner particles, 0.6 parts by mass of hydrophobic silica (a number average primary particle diameter of 12 nm and a hydrophobicity of 68) and 1.0 parts by mass of hydrophobic titanium oxide (a number average primary particle diameter of 20 nm and a hydrophobicity of 63) were added and mixed with a Henschel mixer (Nippon Coke & Engineering Co., Ltd.) at 32° C. for 20 minutes at a rotary blade circumferential speed of 35 mm/sec. Subsequently, coarse particles were removed by using a mesh sieve (filter) having an opening size of 45 μm. Thus, a toner T1 was produced.

<Production of Toner T2>

A toner T2 was produced in the same manner as the toner T1 was produced except that a magenta colorant particle dispersion (M-1) described below was used instead of the black colorant particle dispersion [Bk].

(Preparation of Magenta Colorant Particle Dispersion (M-1))

95 parts by mass of sodium n-dodecyl sulfate were added to 1,600 parts by mass of ion exchanged water. While this solution was stirred, 250 parts by mass of C.I. Pigment Red 122 were gradually added thereto, and subsequently dispersed with a dispersion machine CLEARMIX (manufactured by M Technique Co., Ltd.). Thus, a magenta colorant particle dispersion (M-1) was prepared.

The volume-based median diameter of the magenta colorant particles in the magenta colorant particle dispersion (M-1) was 115 nm.

<Production of Toner T3>

A toner T3 was produced in the same manner as the toner T1 was produced except that a UV absorber (UV-1) was further added as described below.

(Preparation of UV Absorber Particle Dispersion (UV-1))

80 parts by mass of dichloromethane and 20 parts by mass of a benzophenone UV absorber (Uvinul 3049 manufactured by BASF) were mixed and stirred while heated at 50° C. Thus, a UV absorber-containing solution was obtained. To 100 parts by mass of the solution, a mixed liquid of 99.5 parts by mass of distilled water warmed up to 50° C. and 0.5 parts by mass of a 20 mass % sodium dodecylbenzenesulfonate aqueous solution was added. Thereafter, the resulting solution was stirred at 16,000 rpm for 20 minutes with a homogenizer provided with a shaft generator 18F (manufactured by Heidolph Instruments) to be emulsified. Thus, a UV absorber emulsified liquid 1 was obtained.

The obtained UV absorber emulsified liquid 1 was poured to a separable flask, and heated and stirred at 40° C. for 90 minutes while nitrogen was supplied to a gas phase so that an organic solvent was removed. Thus, a UV absorber particle dispersion (UV-1) was prepared. The particle diameter of the UV absorber particles in the UV absorber particle dispersion (UV-1) was measured with an electrophoretic light scattering photometer ELS-800 (manufactured by Otsuka Electronics Co., Ltd.), and it was 145 nm in terms of mass mean particle diameter.

(Production of Toner T3)

Into a reaction vessel equipped with a stirrer, a temperature sensor and a cooling tube, 155 parts by mass (in terms of solid content) of the amorphous resin particle dispersion (X1) and 2,000 parts by mass of ion exchanged water were poured. Thereafter, a 5 mol/L sodium hydroxide aqueous solution was added to adjust pH to 10 at 30° C.

To the pH-adjusted amorphous resin particle dispersion (X1), 40 parts by mass (in terms of solid content) of the black colorant particle dispersion [Bk] and 40 parts by mass (in terms of solid content) of the UV absorber particle dispersion (UV-1) were poured. The process after this was the same as that of the toner T1 producing method. Thus, the toner T3 was produced.

<Measurement of Softening Temperature of Toner>

The softening temperature of each of the toners T1 to T3 was measured with a flow tester as described below.

(1) Production of Sample

A sample was produced as follows: placed and flattened out 1.1 g of the toner in a Schale (petri dish) under the environment of a temperature of 20±1° C. and a relative humidity of 50±5%; left the toner for 12 hours or more; applied a pressure of $3.75\times10^8$ Pa (3,820 kg/cm$^2$) to the toner for 30 seconds with a molding machine SSP-A (manufactured by Shimadzu Corporation), thereby producing a cylindrical molded sample having a diameter of 1 cm.

(2) Measurement of Softening Temperature

The softening temperature was measured as follows: set the molded sample in a flow tester CFT-500D (manufactured by Shimadzu Corporation) under the environment of a temperature of 24±5° C. and a relative humidity of 50±20%; after preheating, extruded the molded sample from a hole (1 mm×1 mm) of a cylindrical die with a piston having a diameter of 1 cm with conditions of an applied load of 196 N (20 kgf), an initial temperature of 60° C., a preheating time of 300 seconds and a temperature rising rate of 6° C. per minute; and took, as the softening temperature of the toner, an offset method temperature T (offset) measured by the method of measuring a melting point while increasing temperature, setting an offset value at 5 mm.

As a result, the softening temperatures of the toners T1, T2 and T3 were 99° C., 99° C. and 97° C., respectively.

<Production of Developer>

With each of the toners T1 to T3, a ferrite carrier coating a copolymer resin of cyclohexyl methacrylate and methyl methacrylate (monomer mass ratio=1:1) and having a volume mean particle diameter of 30 μm was mixed for 30 minutes with a V-type mixer so as to be a toner concentration of 6 mass %. Thus, developers 1 to 3 were produced.

<Preparation of Evaluation Instrument 1>

As an evaluation instrument (electrophotographic image forming apparatus) 1, bizhub PRESS C1080 manufactured by Konica Minolta, Inc. was prepared. Apart from this, the image post-processing apparatus including the glossiness control unit 100 and the temperature control unit 300 shown in FIG. 7 was prepared.

As shown in FIG. 7, the glossiness control unit 100 includes the light emitter 103 and the controller 101. Further, as shown in FIG. 7, the temperature control unit 300 includes the heater 302A (IR heater) and the controller 301.

As the light source in the light emitter 103, LEDs having a maximum emission wavelength of 365 nm (365 nm±20 nm) were used. As the heater 302A in the temperature control unit 300, one constituted of a carbon heater as a heat source installed in a heat-insulating cover was used.

<Preparation of Evaluation Instrument 2>

As an evaluation instrument 2, bizhub PRESS C1080 manufactured by Konica Minolta, Inc. was modified such that a charger(s), an exposure unit(s), a developing unit(s), a transfer unit(s) and a glossiness control unit were installed in this order, so that an image forming apparatus which can perform the image post-processing method of the present invention (shown in FIG. 9 and FIG. 10) was prepared.

As shown in FIG. 9, the glossiness control unit 100 includes the light emitter 103 and the controller 101. Further, as shown in FIG. 9, the temperature control unit 300 includes the fixing roller 92, the pressure roller 93 and the controller 301.

As the light source in the light emitter 103, LEDs having a maximum emission wavelength of 365 nm (365 nm±20 nm) were used. In the temperature control unit 300, a fixing device which can fix toner images to recording media (fixing step) and heat the toner images was used.

<Image Post-processing Condition 1>

Figure 11:
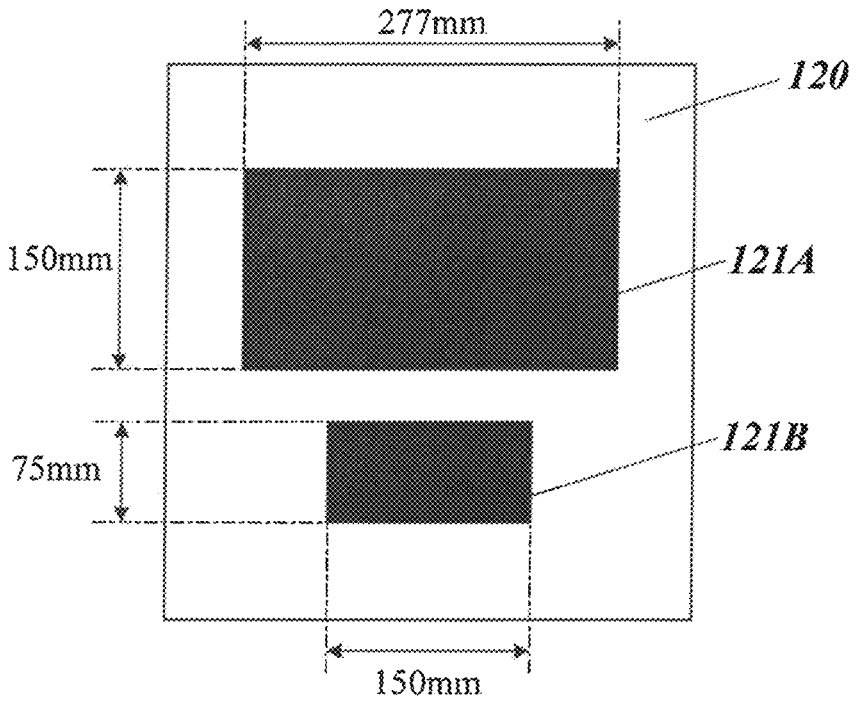
FIG. 11 is a diagram showing a toner image A and a toner image B fixed to a recording medium.

For an image post-processing condition 1, the evaluation instrument 1 was used. In bizhub PRESS C1080 manufactured by Konica Minolta, Inc. as an image forming apparatus, a toner image(s) formed of the developer 1 was fixed to a recording medium. More specifically, as shown in FIG. 11, an evaluation target image constituted of a solid toner image 121A (toner image A) and a solid toner image 121B was output to an A3 coated sheet (basis weight: 128 g/m$^2$) as a recording medium. The toner image A had a size of 150 mm (in the longer direction of the recording medium)×277 mm (in the shorter direction of the recording medium), and its center point was located on the center line in the shorter direction of the recording medium, 105 mm from the top in the longer direction of the recording medium. The toner image B had a size of 75 mm (in the longer direction of the recording medium)×150 mm (in the shorter direction of the recording medium), and its center point was located on the center line in the shorter direction of the recording medium, 315 mm from the top in the longer direction of the recording medium. The evaluation target image was post-processed by the image post-processing apparatus. More specifically, the evaluation target image was moved to the temperature control unit by a conveyor, output of the carbon heater in the temperature control unit was set such that the surface temperature of the toner images A and B (evaluation target image) immediately before emission of the glossiness control light became 50° C., and the toner images A and B were heated in the non-contact manner. Next, the evaluation target image was moved to the light emitter by the conveyor, and the LEDs as the light emitter emitted the glossiness control light to the toner images A and B, the surface temperature of which was 50° C., with a light amount of 0.9 J/cm$^2$.

<Image Post-processing Conditions 2 to 5>

Image post-processing was performed with respective image post-processing conditions 2 to 5 which are the same as the image post-processing condition 1 except that the output of the heater was changed such that the surface temperature of the toner images A and B immediately before emission of the glossiness control light became those shown in TABLE I, and the light amount of the glossiness control light was changed to those shown in TABLE I.

<Image Post-processing Condition 6>

For an image post-processing condition 6, the evaluation instrument 2 was used. In the image forming apparatus of the evaluation instrument 2, a toner image(s) formed of the developer 1 was fixed to a recording medium in the fixing step via the charging step, the exposing step, the developing step and the transferring step. More specifically, as shown in FIG. 11, an evaluation target image constituted of a solid toner image 121A (toner image A) and a solid toner image 121B was output to an A3 coated sheet (basis weight: 128 g/m$^2$) as a recording medium. The toner image A had a size of 150 mm (in the longer direction of the recording medium)×277 mm (in the shorter direction of the recording medium), and its center point was located on the center line in the shorter direction of the recording medium, 105 mm from the top in the longer direction of the recording medium. The toner image B had a size of 75 mm (in the longer direction of the recording medium)×150 mm (in the shorter direction of the recording medium), and its center point was located on the center line in the shorter direction of the recording medium, 315 mm from the top in the longer direction of the recording medium. The recording medium to which the heated toner images A and B were fixed in the fixing step was immediately conveyed to the glossiness control unit by a conveyor. The surface temperature of the toner images A and B (evaluation target image) immediately before emission of the glossiness control light was 50° C. Next, the LEDs as the light emitter emitted the glossiness control light to the toner images A and B, the surface temperature of which was 50° C., with a light amount of 1.0 J/cm$^2$.

<Image Post-processing Conditions 7 to 11>

Image post-processing was performed with respective image post-processing conditions 7 to 11 which are the same as the image post-processing condition 1 except that the maximum emission wavelength and the light amount of the glossiness control light were changed to those shown in TABLE I.

<Image Post-processing Condition 12>

Image post-processing was performed with an image post-processing condition 12 which is the same as the image post-processing condition 1 except that the toner images A and B were formed of the developer 2 produced by using the toner T2, and the light amount of the glossiness control light was changed to that shown in TABLE I.

<Image Post-processing Condition 13>

Image post-processing was performed with an image post-processing condition 13 which is the same as the image post-processing condition 1 except that the toner images A and B were formed of the developer 3 produced by using the toner T3, and the light amount of the glossiness control light was changed to that shown in TABLE I.

<Image Post-processing Condition 14>

Image post-processing was performed with an image post-processing condition 14 which is the same as the image post-processing condition 1 except that the light amount of the glossiness control light was changed to that shown in TABLE I.

<Image Post-processing Conditions 15 and 16>

Image post-processing was performed with respective image post-processing conditions 15 and 16 which are the same as the image post-processing condition 1 except the following points.

In the image post-processing condition 15, the glossiness control light was emitted to the toner image A with a light amount of 0.9 J/cm$^2$, whereas no glossiness control light was emitted to the toner image B.

In the image post-processing condition 16, the glossiness control light was emitted to the toner image A a light amount of 2.9 J/cm$^2$, whereas the glossiness control light was emitted to the toner image B with a light amount of 0.9 J/cm$^2$.

<Image Post-processing Condition 17>

Image post-processing was performed with an image post-processing condition 17 which is the same as the image post-processing condition 1 except that no heating was performed before light emission. That is, the temperature control was not performed, and hence the surface temperature of the toner images A and B immediately before emission of the glossiness control light was 25° C.

<Image Post-processing Condition 18>

Image post-processing was performed with an image post-processing condition 18 which is the same as the image post-processing condition 1 except that the heating (temperature control) was performed such that the surface temperature of the toner images A and B immediately before emission of the glossiness control light became 90° C., and the light amount of the glossiness control light was changed to that shown in TABLE I.

<Image Post-processing Conditions 19 to 21>

Image post-processing was performed with respective image post-processing conditions 19 to 21 which are the same as the image post-processing condition 1 except that the maximum emission wavelength of the light source used in the light emitter (i.e. the maximum emission wavelength of the glossiness control light) was changed to those shown in TABLE I, and the light amount thereof was changed to those (J/cm$^2$) shown in TABLE I.

In the image post-processing condition 19, no glossiness control light was emitted to both the toner image A and the toner image B.

<Evaluation of Change in Glossiness>

With respect to each of the toner images A and the toner images B after the image post-processing, the glossiness (%) at an incident angle of 60° was measured at three points in total on the toner image with a gloss meter (Multi Gloss 268Plus manufactured by Konica Minolta, Inc.), and the average value thereof was taken as the glossiness (%). The three points were: the center point of the image; and one point in each direction of the short axis direction of the recording medium at an interval of 50 mm from the center point of the image. Similarity, the initial glossiness of each of the toner images A and the toner images B before light emission was measured.

In addition, the absolute value of the difference between the glossiness of each toner image before light emission and the glossiness of the toner image after light emission was calculated. The glossiness difference being 3% or more was regarded as a pass, whereas the glossiness difference being less than 3% was regarded as a fail. The evaluation result is shown in TABLE II.

<Evaluation of Glossiness Unevenness>

With respect to each toner image after the image post-processing, glossiness unevenness was visually evaluated by sensory evaluation in accordance with the criteria below. The evaluation result is shown in TABLE II, and "◎" (double circle) and "○" (circle) indicate a pass.

◎ (double circle): glossiness unevenness is not visible at all

○ (circle): glossiness unevenness is slightly visible, but it is not a problem in practical use Δ (triangle): glossiness unevenness is visible, but it is not a problem in practical use x (cross): glossiness unevenness is clearly visible, and it is a problem in practical use

TABLE I

| | TONER | | | | | |
|---|---|---|---|---|---|---|
| | | LIGHT ABSORBING COMPOUND | | SOFTENING | HEATING DEVICE IN TEMPERATURE | |
| *1 | NO. | COLORANT | UV ABSORBER | TEMPERATURE [° C.] | CONTROL UNIT | *2 |
| 1 | T1 | BLACK | — | 99 | IR HEATER | 50 |
| 2 | T1 | BLACK | — | 99 | IR HEATER | 30 |
| 3 | T1 | BLACK | — | 99 | IR HEATER | 79 |
| 4 | T1 | BLACK | — | 99 | IR HEATER | 40 |
| 5 | T1 | BLACK | — | 99 | IR HEATER | 69 |
| 6 | T1 | BLACK | — | 99 | FIXING ROLLER | 50 |
| 7 | T1 | BLACK | — | 99 | IR HEATER | 50 |
| 8 | T1 | BLACK | — | 99 | IR HEATER | 50 |
| 9 | T1 | BLACK | — | 99 | IR HEATER | 50 |
| 10 | T1 | BLACK | — | 99 | IR HEATER | 50 |
| 11 | T1 | BLACK | — | 99 | IR HEATER | 50 |
| 12 | T2 | MAGENTA | — | 99 | IR HEATER | 50 |
| 13 | T3 | BLACK | UvinuI3049 | 97 | IR HEATER | 50 |
| 14 | T1 | BLACK | — | 99 | IR HEATER | 50 |
| 15 | T1 | BLACK | — | 99 | IR HEATER | 50 |
| 16 | T1 | BLACK | — | 99 | IR HEATER | 50 |
| 17 | T1 | BLACK | — | 99 | — | 25 |
| 18 | T1 | BLACK | — | 99 | IR HEATER | 90 |
| 19 | T1 | BLACK | — | 99 | IR HEATER | 50 |
| 20 | T1 | BLACK | — | 99 | IR HEATER | 50 |
| 21 | T1 | BLACK | — | 99 | IR HEATER | 50 |

| | GLOSSINESS CONTROL LIGHT | | | |
|---|---|---|---|---|
| | MAXIMUM EMISSION | LIGHT AMOUNT [J/cm$^2$] | | |
| *1 | WAVELENGTH [nm] | TONER IMAGE A | TONER IMAGE B | REMARK |
| 1 | 365 | 0.9 | | PRESENT INVENTION |
| 2 | 365 | 1.8 | | PRESENT INVENTION |
| 3 | 365 | 0.5 | | PRESENT INVENTION |
| 4 | 365 | 1.3 | | PRESENT INVENTION |
| 5 | 365 | 0.6 | | PRESENT INVENTION |
| 6 | 365 | 1.0 | | PRESENT INVENTION |
| 7 | 385 | 1.2 | | PRESENT INVENTION |
| 8 | 405 | 1.7 | | PRESENT INVENTION |
| 9 | 280 | 0.7 | | PRESENT INVENTION |
| 10 | 480 | 2.5 | | PRESENT INVENTION |
| 11 | 850 | 3.2 | | PRESENT INVENTION |
| 12 | 365 | 1.2 | | PRESENT INVENTION |
| 13 | 365 | 0.6 | | PRESENT INVENTION |
| 14 | 365 | 2.9 | | PRESENT INVENTION |
| 15 | 365 | 0.9 | NO EMISSION | PRESENT INVENTION |
| 16 | 365 | 2.9 | 0.9 | PRESENT INVENTION |
| 17 | 365 | 2.0 | | COMPARATIVE EXAMPLE |
| 18 | 365 | 0.4 | | COMPARATIVE EXAMPLE |
| 19 | NO EMISSION | NO EMISSION | | COMPARATIVE EXAMPLE |
| 20 | 240 | 2.0 | | COMPARATIVE EXAMPLE |
| 21 | 950 | 2.0 | | COMPARATIVE EXAMPLE |

*1 IMAGE POST-PROCESSING CONDITION

*2 TONER IMAGE SURFACE TEMPERATURE[° C.]

TABLE II

| | GLOSSINESS BEFORE POST-PROCESSING [%] | | GLOSSINESS AFTER POST-PROCESSING [%] | | EVALUATION | | | | |
|---|---|---|---|---|---|---|---|---|---|
| | | | | | CHANGE IN GLOSSINESS | | GLOSSINESS UNEVENNESS | | |
| *2 | TONER IMAGE A | TONER IMAGE B | TONER IMAGE A | TONER IMAGE B | TONER IMAGE A | TONER IMAGE B | TONER IMAGE A | TONER IMAGE B | REMARK |
| 1 | 42 | | 25 | | PASS | | ◎ | | PRESENT INVENTION |
| 2 | 42 | | 26 | | PASS | | ◎ | | PRESENT INVENTION |
| 3 | 42 | | 26 | | PASS | | ○ | | PRESENT INVENTION |
| 4 | 42 | | 27 | | PASS | | ◎ | | PRESENT INVENTION |
| 5 | 42 | | 25 | | PASS | | ◎ | | PRESENT INVENTION |
| 6 | 42 | | 26 | | PASS | | ◎ | | PRESENT INVENTION |
| 7 | 42 | | 27 | | PASS | | ◎ | | PRESENT INVENTION |
| 8 | 42 | | 29 | | PASS | | ◎ | | PRESENT INVENTION |
| 9 | 42 | | 25 | | PASS | | ◎ | | PRESENT INVENTION |
| 10 | 42 | | 32 | | PASS | | ◎ | | PRESENT INVENTION |
| 11 | 42 | | 34 | | PASS | | ◎ | | PRESENT INVENTION |
| 12 | 41 | | 30 | | PASS | | ◎ | | PRESENT INVENTION |
| 13 | 44 | | 25 | | PASS | | ◎ | | PRESENT INVENTION |
| 14 | 42 | | 54 | | PASS | | ◎ | | PRESENT INVENTION |
| 15 | 42 | 42 | 25 | 42 | PASS | — | ◎ | — | PRESENT INVENTION |
| 16 | 42 | 42 | 54 | 25 | PASS | PASS | ◎ | ◎ | PRESENT INVENTION |
| 17 | 42 | | 26 | | PASS | | Δ | | COMPARATIVE EXAMPLE |
| 18 | 42 | | 25 | | PASS | | X | | COMPARATIVE EXAMPLE |
| 19 | 42 | | 42 | | — | | — | | COMPARATIVE EXAMPLE |
| 20 | 42 | | *1 | | FAIL | | X | | COMPARATIVE EXAMPLE |
| 21 | 42 | | 41 | | FAIL | | ◎ | | COMPARATIVE EXAMPLE |

*1 GLOSS UNIFORMITY GREATLY DECREASED, AND GLOSSINESS WAS UNMEASURABLE.
*2 IMAGE POST-PROCESSING CONDITION

From the results shown in TABLE II, the image post-processing conditions of the present invention showed excellent results in both change in glossiness and glossiness unevenness. On the other hand, the image post-processing conditions of the comparative examples showed poor results in at least one of change in glossiness and glossiness unevenness.

Hence, it is known that the glossiness can be adjusted by the image post-processing method having the glossiness control step of, to a toner image(s) formed of a toner containing a light absorbing compound and fixed to a recording medium (media), emitting glossiness control light having a maximum emission wavelength in a wavelength range in which the compound absorbs light and made to at least reduce glossiness of the toner image so as to reduce or increase the glossiness of the toner image.

The image post-processing method of the present invention can control the glossiness of the toner image not by changing the fixing temperature like a conventional image post-processing method but by simply emitting predetermined glossiness control light to the toner image. Hence, the image post-processing method of the present invention can control the glossiness of the toner image with no influence on the fixability of the toner image.

In the present invention, before light emission, the toner image is heated to have a surface temperature which is at least 20° C. lower than the softening temperature of the toner. This can heat the toner image to the extent that the glossiness does not change, and make the light amount to be emitted necessary to achieve desired glossiness small. From this, it is conjectured that glossiness unevenness after light emission is less, and image texture uniformity is improved.

On the other hand, with the image post-processing condition 17 of the comparative example, glossiness unevenness occurred. The reason is considered as follows: because no heating was performed before light emission, temperature unevenness occurred on the surface(s) of the toner images A and B, and visible glossiness unevenness occurred.

Further, with the image post-processing condition 18 of the comparative example, glossiness unevenness occurred. The reason is considered as follows: because in the temperature control step, the toner images A and B were heated to have a surface temperature which was not at least 20° C. lower than the softening temperature of the toner, temperature unevenness occurred by the heating, and glossiness unevenness occurred on the toner images A and B after light emission.

The graph as shown in FIG. 4 can be created, for example, as follows: emit glossiness control light having a predetermined maximum emission wavelength with an arbitrary light amount to a toner image fixed to a recording medium; measure the glossiness (%) of the toner image irradiated with the glossiness control light; and plot the glossiness (%) with respect to the emitted light amount. By using such a graph, if a user specifies certain glossiness, the light amount for the glossiness can be calculated, so that the glossiness control light can be emitted to a toner image with the light amount for the specified glossiness.

The image post-processing method of the present invention can change the glossiness of only a portion of a toner image(s) by emitting the glossiness control light thereto. That is, if only a portion of a toner image(s) at a specific position is specified, the image post-processing method can reduce or increase the glossiness of only the portion.

Although one or more embodiments of the present invention have been described and shown in detail, the disclosed embodiments are made for purposes of illustration and example only and not limitation. The scope of the present invention should be interpreted by terms of the appended claims.

The entire disclosure of Japanese Patent Application No. 2017-241271 filed on Dec. 18, 2017 is incorporated herein by reference in its entirety.

What is claimed is:

1. An image post-processing method for adjusting glossiness of a fixed toner image, comprising:

a glossiness control step of, to a toner image formed of a toner containing a light absorbing compound and fixed to a recording medium, emitting glossiness control light having a maximum emission wavelength in a wavelength range in which the compound absorbs light and made to reduce or increase the glossiness of the toner image, wherein when the glossiness is required to be lowered, the glossiness control light is emitted to the toner image with a first light amount which does not re-melt but softens the toner to reduce the glossiness by increasing irregularity on the surface of the toner image, and when the glossiness is required to be increased, the glossiness control light is emitted to the toner image with a second light amount that is larger than the first light amount which re-melts the toner to increase the glossiness by smoothing the surface of the toner image; and a temperature control step of heating the toner image immediately before the glossiness control light is emitted to the toner image such that the toner image has a surface temperature which is at least 20° C. lower than a softening temperature of the toner.

2. The image post-processing method according to claim 1, wherein the temperature control step is a step of performing the heating without contacting a face of the toner image to be irradiated with the glossiness control light.

3. The image post-processing method according to claim 1, wherein the temperature control step is a step of fixing the toner image to the recording medium before the glossiness control step.

4. The image post-processing method according to claim 1, wherein the temperature control step is a step of heating the toner image immediately before the glossiness control light is emitted to the toner image such that the toner image has the surface temperature which is 40° C. or higher.

5. The image post-processing method according to claim 1, wherein the temperature control step is a step of heating the toner image immediately before the glossiness control light is emitted to the toner image such that the toner image has the surface temperature which is at least 30° C. lower than the softening temperature of the toner.

6. The image post-processing method according to claim 1, wherein in the glossiness control step, a light amount of the glossiness control light is adjusted based on glossiness information specified by a user.

7. The image post-processing method according to claim 1, wherein in the glossiness control step, a light amount of the glossiness control light is adjusted based on relationship information on change in the glossiness of the toner image with respect to the light amount of the glossiness control light to be emitted.

8. The image post-processing method according to claim 1, wherein in the glossiness control step, an irradiation position to which the glossiness control light is emitted is set based on position information on the toner image, the position information being specified by a user.

9. The image post-processing method according to claim 1, wherein in the glossiness control step, the glossiness control light is emitted to the toner image fixed to a plurality of portions on the recording medium.

10. The image post-processing method according to claim 1, wherein the glossiness control light has the maximum emission wavelength in the wavelength range of 280 nm to 850 nm.

11. The image post-processing method according to claim 1, wherein the glossiness control light has the maximum emission wavelength in the wavelength range of 280 nm to 500 nm.

12. The image post-processing method according to claim 1, wherein a colorant is used as the compound.

13. The image post-processing method according to claim 1, wherein an ultraviolet absorber is used as the compound.

14. The image post-processing method according to claim 1, further comprising, before the glossiness control step, a step of detecting the glossiness of the toner image fixed to the recording medium.

15. An image post-processing apparatus comprising:

a light emitter;

a heating device; and a hardware processor which causes the light emitter to, to a toner image formed of a toner containing a light absorbing compound and fixed to a recording medium, emit glossiness control light having a maximum emission wavelength in a wavelength range in which the compound absorbs light and made to reduce or increase the glossiness of the toner image, wherein when the glossiness is required to be lowered, the glossiness control light is emitted to the toner image with a first light amount which does not re-melt but softens the toner to reduce the glossiness by increasing irregularity on the surface of the toner image, and when the glossiness is required to be increased, the glossiness control light is emitted to the toner image with a second light amount that is larger than the first light amount which re-melts the toner to increase the glossiness by smoothing the surface of the toner image, and causes the heating device to heat the toner image immediately before the glossiness control light is emitted to the toner image such that the toner image has a surface temperature which is at least 20° C. lower than a softening temperature of the toner.

16. An image forming apparatus comprising:

a transfer unit which transfers, onto a recording medium, a toner image formed of a toner containing a light absorbing compound;

a fixing unit which fixes the toner image to the recording medium;

a light emitter;

a heating device; and a hardware processor which causes the light emitter to, to the toner image fixed to the recording medium, emit glossiness control light having a maximum emission wavelength in a wavelength range in which the compound absorbs light and made to reduce or increase the glossiness of the toner image, wherein when the glossiness is required to be lowered, the glossiness control light is emitted to the toner image with a first light amount which does not re-melt but softens the toner to reduce the glossiness by increasing irregularity on the surface of the toner image, and when the glossiness is required to be increased, the glossiness control light is emitted to the toner image with a second light amount that is larger than the first light amount which re-melts the toner to increase the glossiness by smoothing the surface of the toner image, and causes the heating device to heat the toner image immediately before the glossiness control light is emitted to the toner image such that the toner image has a surface temperature which is at least 20° C. lower than a softening temperature of the toner.

17. An image forming apparatus comprising:

a transfer unit which transfers, onto a recording medium, a toner image formed of a toner containing a light absorbing compound; and a fixing unit which fixes the toner image to the recording medium, wherein the image post-processing apparatus according to claim 15 is attached to the image forming apparatus.

18. The image post-processing method according to claim 1, further comprising a temperature detection step of obtaining temperature information on the toner image before the glossiness control step and after the temperature control step, wherein conditions for the glossiness control step are determined based on the obtained temperature information.

* * * * *